US009751192B2

(12) United States Patent
Sharmila et al.

(10) Patent No.: US 9,751,192 B2
(45) Date of Patent: Sep. 5, 2017

(54) POLYMER IMPREGNATED BACKING MATERIAL, ABRASIVE ARTICLES INCORPORATING SAME, AND PROCESSES OF MAKING AND USING

(71) Applicants: SAINT-GOBAIN ABRASIVES, INC., Worcester, MA (US); SAINT-GOBAIN ABRASIFS, Conflans-Sainte-Honorine (FR)

(72) Inventors: Muthukrishnan Sharmila, Chennai (IN); Adiseshaiah K. Sathyanarayanaiah, Chennai (IN); Frank J. Csillag, Hopkinton, MA (US); Srikant Gollapudi, Chennai (IN); Gururajan Balasubramaniam, Bangalore (IN); Dibbur Narasimha Murthy Rao Manjunatha, Bangalore (IN); Akhilesan Sasidharan, Chennai (IN); Akshay Ramesh, Bangalore (IN); Shyam Prasad Komath, Chennai (IN); VelliamKattupudur Samiappan Naveen, Chennai (IN)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 14/857,470

(22) Filed: Sep. 17, 2015

(65) Prior Publication Data

US 2016/0074998 A1 Mar. 17, 2016

(30) Foreign Application Priority Data

Sep. 17, 2014 (IN) ..... 4533/CHE/2014

(51) Int. Cl.
*B24D 11/02* (2006.01)
*D06M 15/41* (2006.01)
(Continued)

(52) U.S. Cl.
CPC ..... *B24D 11/02* (2013.01); *B24D 11/005* (2013.01); *B24D 18/0027* (2013.01);
(Continued)

(58) Field of Classification Search
CPC .. B24D 11/02; B24D 11/005; B24D 18/0027; D06M 5/21; D06M 5/41; D06M 2101/06
(Continued)

(56) References Cited

U.S. PATENT DOCUMENTS 3,296,022 A 1/1967 Timmer et al.
4,084,941 A 4/1978 Cox et al.
(Continued)

FOREIGN PATENT DOCUMENTS

WO 2016044625 A1 3/2016

OTHER PUBLICATIONS

International Search Report from PCT/US2015/050749 dated Dec. 22, 2015, 1 pg.

*Primary Examiner* — George Nguyen
(74) *Attorney, Agent, or Firm* — Abel Law Group, LLP; Joseph P. Sullivan

(57) ABSTRACT

This invention relates to composite backing materials (e.g., polymer impregnated nonwoven fabrics) and coated abrasive articles that include such composite backing materials. This invention also relates to methods of making and using said composite backing materials and coated abrasive articles. The claimed processes and systems related to the use and manufacturing of coated abrasive articles are improved and cost effective.

18 Claims, 16 Drawing Sheets

(51) Int. Cl.
*D06M 15/21* (2006.01)
*B24D 11/00* (2006.01)
*B24D 18/00* (2006.01)
*D06M 101/06* (2006.01)

(52) U.S. Cl.
CPC ..... *D06M 15/21* (2013.01); *D06M 15/41* (2013.01); *D06M 2101/06* (2013.01)

(58) Field of Classification Search
USPC ..... 451/526–530
See application file for complete search history.

(56) References Cited

U.S. PATENT DOCUMENTS 5,520,957 A * 5/1996 Bange ..... B24D 3/20 427/180
5,725,617 A * 3/1998 Hagiwara ..... B24D 11/005 51/295
6,039,775 A * 3/2000 Ho ..... B24D 3/34 51/294
6,239,049 B1 * 5/2001 Follensbee ..... B24D 3/28 442/103
6,257,973 B1 7/2001 Fernand Guiselin
6,312,484 B1 * 11/2001 Chou ..... B24D 3/002 51/295
8,470,061 B2 * 6/2013 Goldsmith ..... B24D 11/02 451/28
8,883,288 B2 * 11/2014 Gaeta ..... B24D 3/20 428/141
2006/0020102 A1 * 1/2006 Qureshi ..... C08J 5/24 528/141
2006/0141918 A1 6/2006 Reinke
2007/0181035 A1 * 8/2007 Wantling ..... B27N 1/006 106/270
2008/0202750 A1 * 8/2008 Rediger ..... C09K 8/805 166/280.2
2009/0205259 A1 8/2009 Burzynski et al.
2009/0325466 A1 12/2009 Kincaid et al.
2010/0129592 A1 * 5/2010 Nishimura ..... B24D 11/02 428/91
2010/0252226 A1 * 10/2010 Bangcuyo ..... B22C 1/2253 164/526
2011/0003536 A1 * 1/2011 Feng ..... B24B 37/24 451/41
2012/0055096 A1 3/2012 Goldsmith et al.

* cited by examiner

POLYMER IMPREGNATED BACKING MATERIAL, ABRASIVE ARTICLES INCORPORATING SAME, AND PROCESSES OF MAKING AND USING

CROSS-REFERENCE TO RELATED APPLICATION

The application claims priority under 35 U.S.C. §119(a) to, and incorporates herein by reference in its entirety for all purposes, Indian Application 4533/CHE/2014, filed Sep. 17, 2014, entitled "Polymer Impregnated Backing Material, Abrasive Articles Incorporating Same, and Processes of Making and Using", to Muthukrishnan SHARMILA et al., which application is incorporated by reference herein in its entirety.

FIELD OF THE DISCLOSURE

The present invention relates generally to polymer impregnated backing materials, abrasive articles including the same, and methods of making and using the polymer impregnated backing materials and abrasive articles.

BACKGROUND

Vulcanized fiber, sometimes also referred to as "vulcanized fibre" or "fish paper", has long been in use in the abrasive arts and refers to a leather-like or horn-like material generally formed from cellulose by compressing layers of chemically treated (for example, with metallic chlorides) cellulose derived from paper, paper pulp, rayon, or cloth. Vulcanized fiber is hydrophilic in nature and prone to absorbing moisture.

Abrasive articles that employ vulcanized fiber as a substrate material suffer from a well-recognized problem of a lack of dimensional stability (commonly called shape distortion, with specific examples of shape distortion being "curling" and "cupping") caused by changes in environmental moisture content (e.g., humidity). The lack of dimensional stability can detrimentally impact abrasive performance and cause premature end of life of an abrasive product (e.g., delamination, excessive warping of the abrasive article). Various approaches have been attempted to solve the problems related to the use of vulcanized fiber substrates but all suffer from certain drawbacks. Therefore, there continues to be a demand for improved abrasive articles.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION

Figure 1:
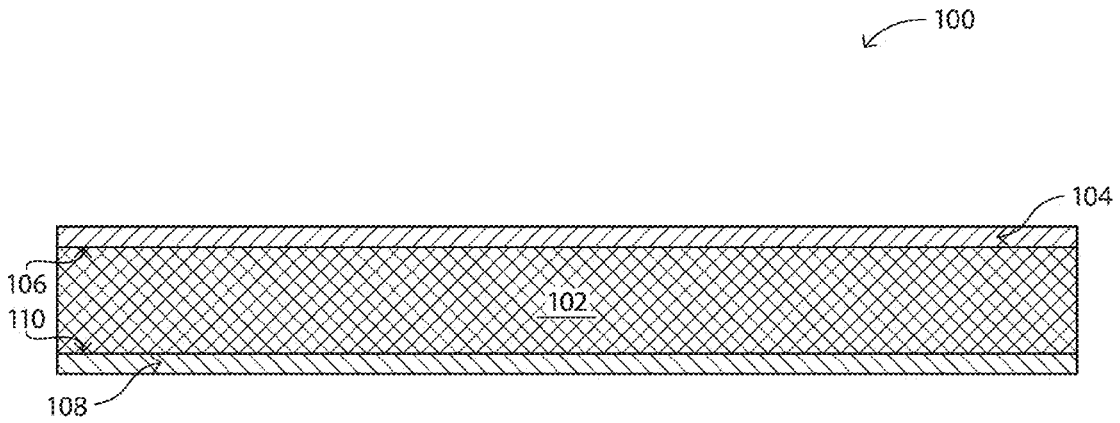
FIG. 1 is an illustration of cross sectional view of an embodiment of a composite backing material.

The following description, in combination with the figures, is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

The term "averaged," when referring to a value, is intended to mean an average, a geometric mean, or a median value. As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25. Moreover, it will be appreciated that references to values stated as "at least about," "greater than," "less than," or "not greater than" can include a range of any minimum or maximum value noted therein.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the coated abrasive arts.

FIG. 1 shows an illustration of a cross section of a composite backing material 100 embodiment. A composite backing material is comprised of a nonwoven fabric 102 impregnated with a first polymer composition and having a front fill layer 104 that is disposed on a first side 106 of the polymer impregnated nonwoven fabric and a back fill layer 108 that is disposed on a second side 110 of the polymer impregnated nonwoven fabric.

Figure 2:
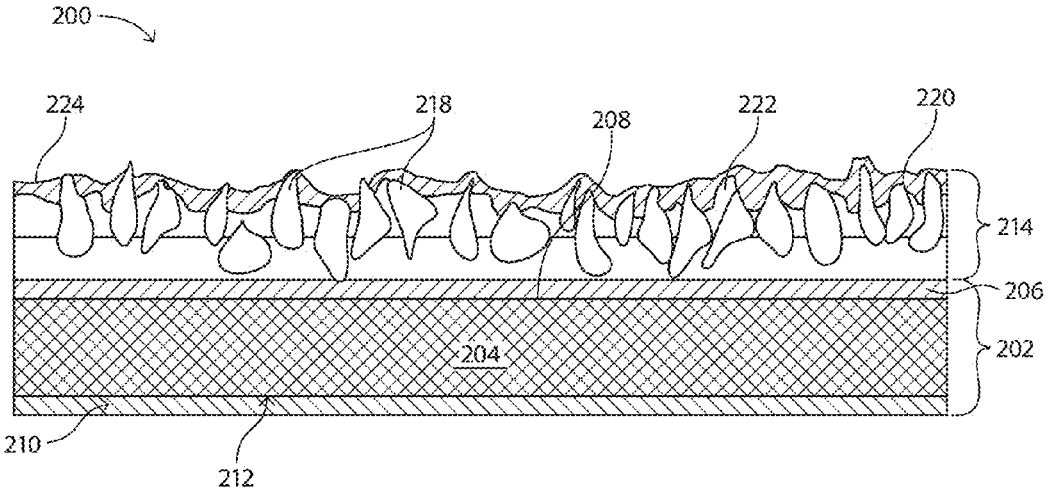
FIG. 2 is an illustration of a cross-sectional view of an embodiment of a coated abrasive that includes a composite backing material.

FIG. 2 shows an illustration of a cross section of a coated abrasive article 200 embodiment. A composite backing material 202 is comprised of a polymer impregnated nonwoven fabric 204 having a front fill layer 206 that is disposed on a first side 208 of the polymer impregnated nonwoven fabric and a back fill layer 210 that is disposed on a second side 212 of the polymer impregnated nonwoven fabric. An abrasive layer 214 is disposed on the front fill layer 206. The abrasive layer 214 comprises abrasive particles 218 disposed on or dispersed in a binder composition 220 (e.g., a make coat or an abrasive slurry). An optional size coat 222 is disposed on the abrasive layer. An optional supersize coat 224 is disposed on the size coat.

Figure 3:
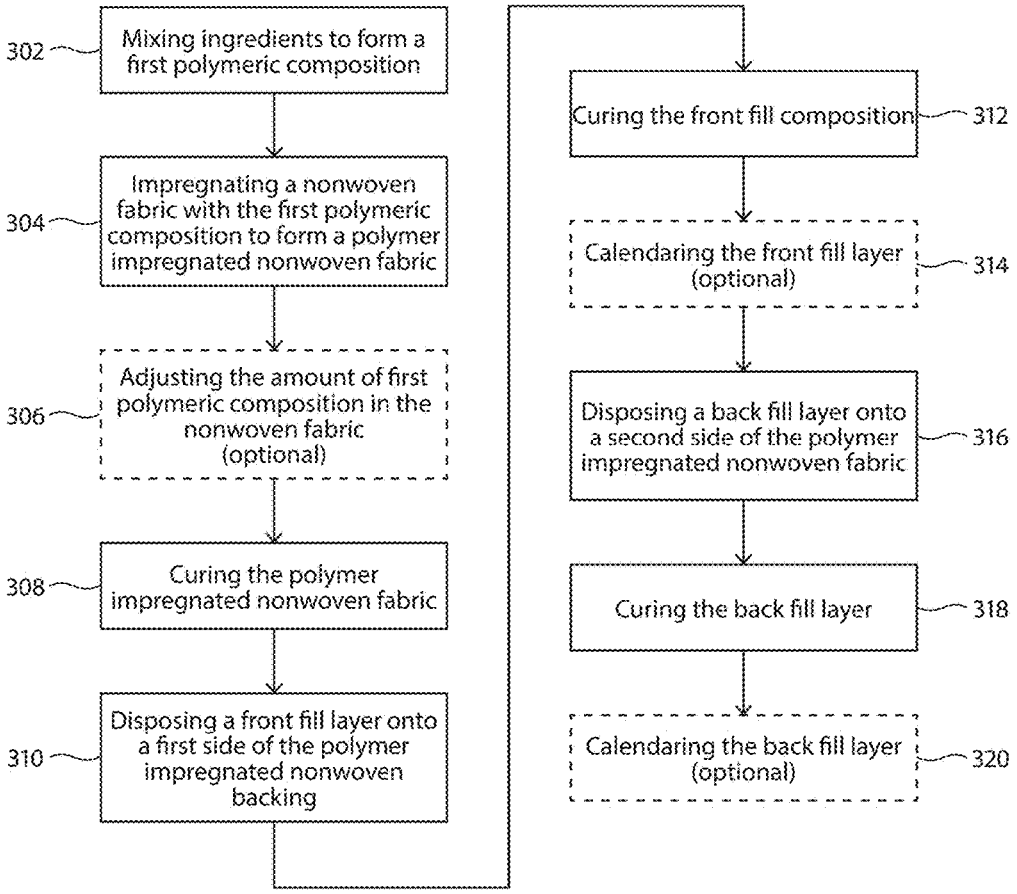
FIG. 3 is an illustration of a flowchart of an embodiment of a method of making composite backing material.

FIG. 3 is an illustration of a flowchart of an embodiment of a method 300 of making composite backing material according to an embodiment. Step 302 includes mixing of ingredients to form a first polymeric composition (also referred to herein as a dip fill composition). In an embodiment, the ingredients comprise a mixture of a combination of phenolic resins and water. Step 304 includes impregnating (also called herein "saturating") a nonwoven fabric with the first polymeric composition to form a polymer impregnated nonwoven fabric. In an embodiment, the nonwoven fabric is a stitch bonded fabric. Optionally, Step 306 includes adjusting the amount of first polymeric composition in the nonwoven fabric (i.e., also referred to herein as adjusting the saturation, or as adjusting the amount of wet add-on weight). Step 308 includes curing, at least partially to fully, the polymer impregnated nonwoven fabric (i.e., curing at least partially to fully the first polymeric composition that permeates the nonwoven fabric). Step 310 includes disposing a front fill layer onto a first side of the polymer impregnated nonwoven fabric. In an embodiment, the front fill layer comprises a second polymer composition (also called herein a front fill composition). Step 312 includes curing, at least partially to fully, the front fill layer. Optionally, step 314 includes calendaring the front fill layer. Step 316 includes disposing a back fill layer onto a second side of the polymer impregnated nonwoven fabric. In an embodiment, the back fill layer can comprise a third polymer formulation (also called herein a back fill composition). During step 318 includes curing, at least partially to fully, of the backfill layer to form the composite backing material. Optionally, step 320 includes calendaring the back fill layer.

Figure 4:
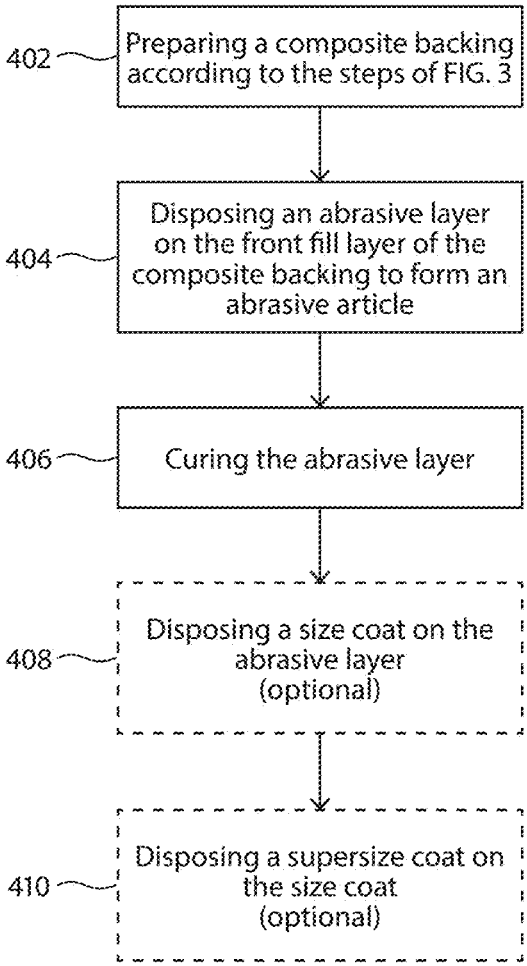
FIG. 4 is flowchart of an embodiment of a method of making an abrasive article that includes a composite backing material.

FIG. 4 is an illustration of a flowchart of an embodiment of a method 400 of making a composite backing material according to an embodiment. Step 402 includes preparing a composite backing material according to the steps of the method described above in FIG. 3. Step 404 includes disposing an abrasive layer on the front fill layer of the composite backing material to form an abrasive article. Step 406 includes curing, at least partially to fully, of the abrasive layer. Optionally, step 408 includes disposing a size coat on the abrasive layer. Optionally, step 410 includes disposing a super-size coat on the size coat.

Figure 5:
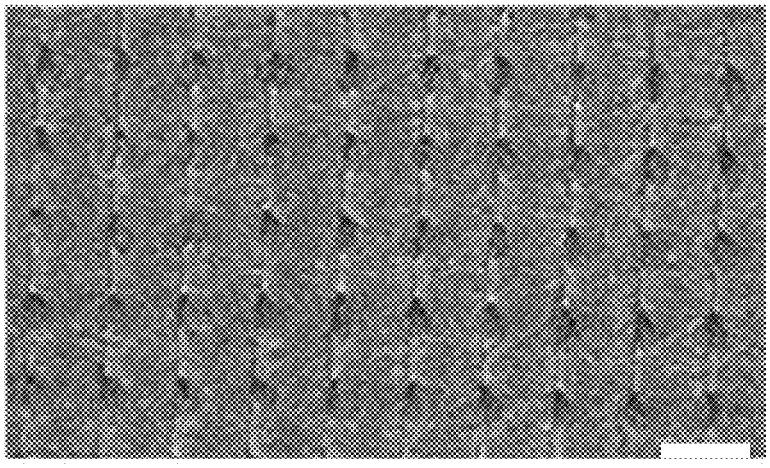
FIG. 5 is a photograph of a top view of a nonwoven stitch bonded fabric suitable for use in an embodiment.

FIG. 5 is an illustration of an example of a nonwoven stitch bonded fabric comprised of a plurality of batts (also called "webs" herein) joined together by a thread that is stitched through the plurality of batts. In an embodiment, the stitch bonded fabric comprises three batts.

Composite Backing Material

A composite backing material can comprise a polymer impregnated nonwoven fabric having a front fill composition disposed on a first side of the polymer impregnated nonwoven fabric and a back fill composition disposed on a second side of the polymer impregnated nonwoven fabric. The composite backing material possesses beneficial physical properties that contribute to unexpected beneficial and superior abrasive performance of abrasive articles that include the composite backing material.

Polymer Impregnated Nonwoven Fabric

The polymer impregnated nonwoven fabric comprises a nonwoven fabric impregnated (i.e., saturated with) with a first polymeric composition (also called herein a "dip fill" composition or a "saturating" composition or a "saturant" composition).

The nonwoven fabric can be an organic material, an inorganic material, a natural material, a synthetic material, or a combination thereof. The nonwoven fabric can be flexible, rigid, or a combination thereof. The nonwoven fabric can comprise a single type of fiber or a plurality of different types of fibers. The nonwoven fabric can comprise polyester, cotton, nylon, silk, cellulose, cotton, viscose, jute, polyamide, polyamine, aramide, poly-cotton, rayon, or combinations thereof. Specific synthetics can comprise Kevlar, Nomex, and combinations thereof. The fabric can comprise virgin fibers or recycled fibers. The nonwoven fabric can be a finished fabric, or an unfinished fabric (i.e. "grey fabric"), or a combination thereof. In a particular embodiment, the nonwoven fabric is a polyester fabric.

The nonwoven fabric can be a spun lace fabric, a chemically bonded fabric, a thermally bonded fabric, a needle punched fabric, a stitch-bonded fabric, or combinations thereof. A stitch bonded fabric can be a maliwatt fabric, a malivies fabric, a malimo fabric, a malipol fabric, a voltex fabric, a kunit fabric, a multiknit fabric, or combinations thereof, and the like. In an embodiment, the nonwoven fabric is a stitch bonded fabric.

The stitch bonded fabric can comprise a single web (also called a batt) or a plurality of webs (batts). In an embodiment, the number of webs of the stitch bonded fabric can be not less than 1 web, such as not less than 2 webs, not less than 3 webs, or not less than 4 webs. In another embodiment, the number of webs of the stitch bonded fabric can be not greater than 10 webs, such as not greater than 9 webs, not greater than 8 webs, not greater than 7 webs, or not greater than 6 webs. The number of webs of the stitch bonded fabric can be within a range comprising any pair of the previous upper and lower limits. In a particular embodiment, the number of webs of the stitch bonded fabric is in the range of 1 to 10 webs, such as 2 to 8 webs, or 3 to 7 webs. In a particular embodiment, the stitch bonded material comprises 3 webs.

The stitch bonded fabric can have a particular type of stitch bond. The stitch bonded fabric can be a warp stitch bonded fabric, a weft stitch bonded fabric, or a combination thereof. In an embodiment, the stitch bonded fabric is warp stitch bonded fabric. The stitch bonded fabric can include any known stitch or combination of stitches in the stitch bonded fabric art. In a particular embodiment, the stitch bonded fabric includes a chain stitch.

The nonwoven fabric and have a particular mass per unit area, such as g/m2 (GSM), commonly called the "weight" of the fabric. In an embodiment, the weight of the nonwoven fabric can be not less than 50 GSM, not less than 100 GSM, not less than 200 GSM, not less than 300 GSM, or not less than 350 GSM. In another embodiment, the weight of the nonwoven fabric can be not greater than 600 GSM, not greater than 500 GSM, not greater than 450 GSM, not greater than 400 GSM, or not greater than 390 GSM. The amount of weight of the nonwoven fabric can be within a range comprising any pair of the previous upper and lower limits. In a particular embodiment, the amount of weight of the nonwoven fabric can be in the range of not less than 50 GSM to not greater than 600 GSM, such as not less than 100 GSM to not greater than 500 GSM, not less than 200 GSM to not greater than 400 GSM, such as not less than 300 GSM to not greater than 390 GSM.

The nonwoven fabric can have a particular tensile strength in the Machine Direction (M/D). In an embodiment, the tensile strength of the nonwoven fabric in the M/D can be not less than 1 kgf/25 mm, not less than 5 kgf/25 mm, not less than 10 kgf/25 mm, or not less than 15 kgf/25 mm. In another embodiment, the tensile strength of the nonwoven fabric in the M/D can be not greater than 100 kgf/25 mm, not greater than 60 kgf/25 mm, not greater than 50 kgf/25 mm, or not greater than 40 kgf/25 mm. The tensile strength of the nonwoven fabric can be within a range comprising any pair of the previous upper and lower limits. In a particular embodiment, the tensile strength of the nonwoven fabric in the M/D can be in a range of not less than 1 kgf/25 mm to not greater than 100 kgf/25 mm, such as 5 kgf/25 mm to 60 kgf/25 mm, such as 10 kgf/25 mm to 50 kgf/25 mm, or 15 kgf/25 mm to 40 kgf/25 mm.

The nonwoven fabric can have a particular tensile strength in the Cross Direction (C/D). In an embodiment, the tensile strength of the nonwoven fabric in the C/D can be not less than 1 kgf/25 mm, not less than 5 kgf/25 mm, not less than 10 kgf/25 mm, or not less than 15 kgf/25 mm. In another embodiment, the tensile strength of the nonwoven fabric in the C/D can be not greater than 100 kgf/25 mm, not greater than 60 kgf/25 mm, not greater than 50 kgf/25 mm, or not greater than 40 kgf/25 mm. The tensile strength of the nonwoven fabric can be within a range comprising any pair of the previous upper and lower limits. In a particular embodiment, the tensile strength of the nonwoven fabric in the C/D can be in a range of not less than 1 kgf/25 mm to not greater than 100 kgf/25 mm, such as 5 kgf/25 mm to 60 kgf/25 mm, such as 10 kgf/25 mm to 50 kgf/25 mm, or 15 kgf/25 mm to 40 kgf/25 mm.

The nonwoven fabric can have a particular tensile strength in the M/D and in the C/D such that the tensile strength in the M/D and tensile strength in the C/D have a particular relationship to each other. In an embodiment, the tensile strength in the M/D is greater than the tensile strength in the C/D. In another embodiment, the tensile in the M/D is less than the tensile strength in the C/D. In another embodiment, the tensile strength in the M/D is approximately the same as the tensile strength in the C/D. In an embodiment, the tensile strength in the M/D and in the C/D can both be greater than a particular minimum value. In an embodiment, the tensile strength of the nonwoven fabric in both the M/D and in the C/D can be not less than 1 kgf/25 mm, not less than 5 kgf/25 mm, not less than 10 kgf/25 mm, or not less than 15 kgf/25 mm. In another embodiment, the tensile strength of the nonwoven fabric in both the M/D and in the C/D can be not greater than 100 kgf/25 mm, not greater than 60 kgf/25 mm, not greater than 50 kgf/25 mm, or not greater than 40 kgf/25 mm. The tensile strength of the nonwoven fabric in both the M/D and in the C/D can be within a range comprising any pair of the previous upper and lower limits. In a particular embodiment, the tensile strength of the nonwoven fabric in both the M/D and in the C/D can be in a range of not less than 1 kgf/25 mm to not greater than 100 kgf/25 mm, such as 5 kgf/25 mm to 60 kgf/25 mm, such as 10 kgf/25 mm to 50 kgf/25 mm, or 15 kgf/25 mm to 40 kgf/25 mm.

The nonwoven fabric can have a particular elastic modulus, also known as "Young's modulus" or "tensile modulus". In an embodiment, the elastic modulus of the nonwoven fabric can be not less than 0.01 GPa, not less than 0.025 GPa, not less than 0.05 GPa, or not less than 0.1 GPa. In another embodiment, the elastic modulus of the nonwoven fabric can be not greater than 1 GPa, not greater than 0.8 GPa, not greater than 0.6 GPa, not greater than 0.5 GPa, or not greater than 0.4 GPa. The elastic modulus of the nonwoven fabric can be within a range comprising any pair of the previous upper and lower limits. In a particular embodiment, the elastic modulus of the nonwoven fabric can be in a range of not less than 0.01 GPa to not greater than 1 GPa, such as 0.1 GPa to 0.4 GPa.

The nonwoven fabric can have a particular elongation at break. In an embodiment, the elongation at break of the nonwoven fabric can be not less than 5 mm, not less than 10 mm, not less than 20 mm, or not less than 25 mm. In another embodiment, the elongation at break of the nonwoven fabric can be not greater than 70 mm, not greater than 60 mm, not greater than 50 mm, or not greater than 45 mm. The elongation at break of the nonwoven fabric can be within a range comprising any pair of the previous upper and lower limits. In a particular embodiment, the elongation at break of the nonwoven fabric can be in a range of not less than 5 mm to not greater than 70 mm, such as 20 mm to 50 mm.

The nonwoven fabric can have a particular thickness. In an embodiment, the thickness of the nonwoven fabric can be not less than 0.2 mm, such as not less than 0.4 mm, not less than 0.5 mm, not less than 0.6 mm, not less than 0.7 mm, not less than 0.8 mm, or not less than 0.9 mm. In another embodiment, the thickness of the nonwoven fabric can be not greater than 4 mm, such as not greater than 3 mm, not greater than 2 mm, not greater than 1.8 mm, not greater than 1.6 mm, not greater than 1.4 mm, or not greater than 1.2 mm. The thickness of the nonwoven fabric can be within a range comprising any pair of the previous upper and lower limits. In a particular embodiment, the thickness of the nonwoven fabric can be in a range of not less than 0.2 mm to not greater than 4 mm, such as 0.5 mm to 0.8 mm or 0.8 mm to 1.4 mm.

The nonwoven fabric can comprise any combination of the above features. In a specific embodiment, the nonwoven fabric comprises a warp stitch bonded polyester fabric having three webs and a weight in a range of 360 to 400 g/m2.

First Polymeric Composition

As stated above, the nonwoven fabric is impregnated with a first polymeric composition. The polymer impregnated nonwoven fabric can be described in terms of the first polymeric composition when cured, partially cured, or fully cured.

A first polymeric composition can be formed of a single polymer or a blend of polymers. The first polymeric composition can comprise a phenolic polymer, a resorcinol polymer, a melamine polymer, a urea polymer, or combinations thereof. The phenolic polymer, melamine polymer, or urea polymer can comprise a single prepolymer resin or a blend of resins. Phenolic polymers can comprise phenol formaldehyde resole resins. Resole resins are generally made using alkali hydroxides with a formaldehyde to phenol ratio of about 1.0 to 3.0 at a pH of 7 to 13. In an embodiment the first polymeric composition comprises a phenolic resole resin. In another embodiment, the first polymeric composition comprises a mixture of a plurality of phenolic resole resins. In an embodiment, the first polymeric composition can comprise from two to five phenolic resole resins. In a specific embodiment, the first polymeric composition comprises a mixture of a first phenolic resole resin and a second phenolic resole resin.

Resole resins can be classified by a number of features, such as the formaldehyde to phenol ratio (F/P ratio) prior to reaction, free formaldehyde content (FFC) of the polymer after reaction, free phenol content (FPC) after reaction, gel time at a specific temperature, and the water tolerance of the resin. In an embodiment, the F/P ratio can be in a range of 0.95 to 2.5, such as 0.95 to 1.1, or 1.2 to 1.5, or 1.6 to 1.8, or 1.9 to 2.2, or a combination thereof. In an embodiment, the FFC can be in a range of 0.02% to 3.3% by weight of the resin, such as about 0.02% to 0.09%, or 0.2% to 0.45%, or 0.5% to 0.8%, or 1.0% to 1.3%, or 2.5% to 3%, or combinations thereof. In an embodiment, the FPC can be in a range of 2% to 5%, or 4% to 7%, or 12% to 15%, or 16% to 20%, or combinations thereof. In an embodiment, the gel time at 121° C. can be in range of 5 minutes to 30 minutes, such as 7-11 minutes, 8-12 minutes, 9-10 minutes, 10-12 minutes, 18-22 minutes, 19-26 minutes, or combinations thereof. In an embodiment, the water tolerance is in a range of 100% to 600%, such as 100 to 300%, 100 to 350%, 150 to 300%, 150 to 350%, 400 to 480%, 400 to 550%, 430 to 500%, or combinations thereof. In an embodiment, the first polymeric composition comprises a phenolic resole resin, also referred to herein as a high temperature (HT) phenolic resin having an F/P ratio in a range of 1.2 to 1.5, a gel time at 121° C. in a range of 18-22 minutes; and a water tolerance in a range of 400 to 480%. In another embodiment, the first polymeric composition comprises a phenolic resole resin, also referred to herein as a low temperature (LT) phenolic resin, having an F/P ratio in a range of 1.6 to 1.8, a gel time at 121° C. in a range of 10-12 minutes; and a water tolerance in a range of 430 to 500%. In another embodiment the first polymeric composition comprises a phenolic resole resin, also referred to herein as "CGF2" phenolic resin, having an F/P ratio in a range of 1.9 to 2.2, a gel time at 121° C. in a range of 7-11 minutes; and a water tolerance in a range of 150 to 300%.

In an embodiment, the uncured first polymeric composition can comprise:

70 wt % to 100 wt % of total phenolic resin; and 0 wt % to 30 wt % water, wherein the percentages are based on a total weight of the first polymeric composition and all the percentages of the ingredients add up to 100 wt %. Optionally, from about 0.1 wt % to about 5 wt % of additives can also be included in the first polymeric composition. If one or more additives are included, the amount of the other ingredients can be adjusted so that the total amounts of the ingredients in the first polymeric composition adds up to 100 wt %. The total phenolic resin can comprise a single phenolic resin, or a plurality of phenolic resins, such as from two to five phenolic resins.

In another embodiment, the uncured first polymeric composition can comprise:

35 wt % to 55 wt % of a first phenolic resin;

35 wt % to 55 wt % of a second phenolic resin; and 0 wt % to 30 wt % water, wherein the percentages are based on a total weight of the first polymeric composition and all the percentages of the ingredients add up to 100 wt %. Optionally, from about 0.1 wt % to about 5 wt % of additives can also be included in the first polymeric composition. If one or more additives are included, the amount of the other ingredients can be adjusted so that the total amounts of the ingredients in the first polymeric composition adds up to 100 wt %. In a particular embodiment, the first phenolic resin is a high temperature (HT) phenolic resin having an F/P ratio in a range of 1.2 to 1.5, a gel time at 121° C. in a range of 18-22 minutes; and a water tolerance in a range of 400 to 480%. In a particular embodiment, the second phenolic resin is a low temperature (LT) phenolic resin, having an F/P ratio in a range of 1.6 to 1.8, a gel time at 121° C. in a range of 10-12 minutes; and a water tolerance in a range of 430 to 500%.

In another embodiment, the uncured first polymeric composition can comprise:

40 wt % to 50 wt % of a first phenolic resin;

40 wt % to 50 wt % of a second phenolic resin and 0 wt % to 20 wt % water, wherein the percentages are based on a total weight of the first polymeric composition and all the percentages of the ingredients add up to 100 wt %. In a particular embodiment, the first phenolic resin is a high temperature (HT) phenolic resin having an F/P ratio in a range of 1.2 to 1.5, a gel time at 121° C. in a range of 18-22 minutes; and a water tolerance in a range of 400 to 480%. In a particular embodiment, the second phenolic resin is a low temperature (LT) phenolic resin, having an F/P ratio in a range of 1.6 to 1.8, a gel time at 121° C. in a range of 10-12 minutes; and a water tolerance in a range of 430 to 500%.

Alternatively, the polymer impregnated fabric can be described with respect to a cured composition. In an embodiment, a cured first polymeric composition can comprise:

95 wt % to 100 wt % of total phenolic resin, wherein the percentages are based on a total weight of the first polymeric composition and all the percentages of the ingredients add up to 100 wt %. Optionally, from about 0.1 wt % to about 5 wt % of additives can also be included in the first polymeric composition. If one or more additives are included, the amount of the other ingredients can be adjusted so that the total amounts of the ingredients in the first polymeric composition adds up to 100 wt %. The total phenolic resin can comprise a single phenolic resin, or a plurality of phenolic resins, such as from two to five phenolic resins.

In another embodiment, the cured first polymeric composition can comprise:

40 wt % to 60 wt % of a first phenolic resin; and 40 wt % to 60 wt % of a second phenolic resin, wherein the percentages are based on a total weight of the first polymeric composition and all the percentages of the ingredients add up to 100 wt %. Optionally, from about 0.1 wt % to about 5 wt % of additives can also be added to the first polymeric composition. If one or more additives are included, the amount of the other ingredients can be adjusted so that the total amounts of the ingredients in the first polymeric composition adds up to 100 wt %. In a particular embodiment, the first phenolic resin is a high temperature (HT) phenolic resin having an F/P ratio in a range of 1.2 to 1.5, a gel time at 121° C. in a range of 18-22 minutes; and a water tolerance in a range of 400 to 480%. In a particular embodiment, the second phenolic resin is a low temperature (LT) phenolic resin, having an F/P ratio in a range of 1.6 to 1.8, a gel time at 121° C. in a range of 10-12 minutes; and a water tolerance in a range of 430 to 500%.

Alternatively, the first polymeric composition can be expressed as a ratio of the first phenolic resole resin and the second phenolic resole resin. In an embodiment, the first phenolic resole resin and the second phenolic resole resin are present in a ratio (first resin:second resin) ranging from 1:9 to 9:1, such as from 1:2 to 2:1; from 1:1.5 to 1.5:1; from 1:1.25 to 1.25:1; or about 1:1.

It will be appreciated that the first polymeric composition can be distributed uniformly or non-uniformly throughout the nonwoven fabric. In an embodiment, the first polymeric composition is uniformly dispersed throughout the nonwoven fabric.

Amount of Impregnation (Saturation)—Add-on Weight

The amount of first polymeric composition that impregnates (i.e., saturates) the nonwoven fabric (i.e., the amount of first polymeric composition that adheres to and/or is absorbed by the nonwoven fabric) is also known as the "add-on" weight of the first polymeric composition. The amount of saturation can be expressed as "wet" add-on weight, which is the weight of the uncured first polymeric composition and can include water. Alternatively, the amount of saturation can be expressed a "dry" add-on weight, which is the weight of the cured first polymeric composition and does not include water. The amount of add-on weight, whether wet add-on weight or dry add-on weight, can be expressed as a percentage of the original weight of the backing material. For example, if the nonwoven fabric weighs: 100 g/m2 prior to impregnation; 150 g/m2 after impregnation (uncured); and 125 g/m2 after curing, then the impregnated nonwoven fabric would be considered 50 wt % saturated "wet" and 25 wt % saturated "dry". Alternatively, the amount of impregnation can be expressed as the mass of the add-on weight of the first polymeric composition. For example, if the nonwoven fabric weighs: 100 g/m2 prior to saturation; weighs 150 g/m2 after saturation (uncured), and 125 g/m2 after curing, then the amount of saturation would be expressed as 50 g/m2 of wet add-on weight and 25 g/m2 of dry add-on weight of first polymeric composition.

The dry add-on weight of the first polymeric composition to the nonwoven fabric can be in a particular range. In an embodiment, the dry add-on weight of the first polymeric composition can be not less than 200 g/m2 (GSM), such as not less than 225 GSM, not less than 250 GSM, not less than 275 GSM, not less than 300 GSM, not less than 325 GSM, not less than 350 GSM, not less than 375 GSM, not less than 400 GSM, or not less than 425 GSM. In another embodiment, the dry add-on weight of the nonwoven fabric can be not greater than 650 GSM, such as not greater than 625

GSM, not greater than 600 GSM, not greater than 575 GSM, not greater than 550 GSM, not greater than 525 GSM, not greater than 500 GSM, or not greater than 475 GSM. The dry add-on weight of the nonwoven fabric can be within a range comprising any pair of the previous upper and lower limits. In a particular embodiment, the dry add-on weight of the nonwoven fabric can be in a range of not less than 200 GSM to not greater than 650 GSM, such as 300 GSM to 550 GSM, such as 400 GSM to 500 GSM, or 425 GSM to 475 GSM.

The dry add-on weight of the first polymeric composition can be a percentage of the weight of the unsaturated nonwoven fabric. In an embodiment, the dry add-on weight of the first polymeric composition can be not less than 50 wt %, such as not less than about 55 wt %, not less than about 60 wt %, not less than about 65 wt %, not less than about 70 wt %, not less than about 75 wt %, not less than about 80 wt %, not less than about 85 wt %, not less than about 90 wt %, or not less than about 95 wt %. In another embodiment, the dry add-on weight of the nonwoven fabric can be not greater than 200 wt %, such as not greater than 190 wt %, not greater than 180 wt %, not greater than 170 wt %, not greater than 160 wt %, not greater than 150 wt %, not greater than 140 wt %, not greater than 135 wt %, not greater than 130 wt %, not greater than 125 wt %, or not greater than 120 wt %. The dry add-on weight of the first polymeric composition can be within a range comprising any pair of the previous upper and lower limits. In a particular embodiment, the dry add-on weight of the first polymeric composition can be in a range of not less than 50 wt % to not greater than 200 wt %, such as 75 wt % to 175 wt %, such as 100 wt % to 150 wt %, or 110 wt % to 140 wt %.

Alternatively, the polymer impregnated nonwoven fabric can be described by the ratio of the weight of the nonwoven fabric ($Weight_{nw}$) to the dry add-on weight of the first polymeric composition ($Weight_{dip}$). In an embodiment, the ratio of $Weight_{nw}$:$Weight_{dip}$ can be in a range from 1.0:0.5 to 1.0:5.0, such as from 1.0:0.75 to 1.0:2.5, from 1.0:1.0 to 1.0:1.5. In a particular embodiment, the ratio of $Weight_{nw}$:$Weight_{dip}$ is in a range from 1.0:1.1 to 1.0:1.25.

Front Fill Layer

As stated above, the composite backing material comprises a polymer impregnated nonwoven fabric having a front fill layer disposed on a first side of the polymer impregnated nonwoven fabric. The front fill layer comprises a second polymeric composition (also called herein the "front fill composition"). The second polymeric composition can be described in terms of being cured, partially cured, or fully cured.

The second polymeric composition can be the same as or different from the first polymeric composition as described above. The second polymeric composition can comprise a single phenolic resole resin or a mixture of a plurality of phenolic resole resins as described above. In an embodiment, the second polymeric composition comprises a mixture of a first phenolic resole resin and a second phenolic resole resin. The first phenolic resole resin and a second phenolic resole resin can be the same as or different from the first phenolic resole resin and a second phenolic resole resin that comprise the first polymeric composition as described above. In an embodiment, the first phenolic resole resin of the second polymeric composition is the same as the first phenolic resole resin present in the first polymeric composition. In another embodiment, the second phenolic resole resin of the second polymeric composition is the same as the second phenolic resole resin present in the first polymeric composition. In another embodiment, the first and second phenolic resole resins are the same as the first and second phenolic resole resins of the first polymeric composition.

The first phenolic resole resin and second phenolic resole resin can be in a particular ratio to each other. In an embodiment, the ratio of first phenolic resole resin to second phenolic resole resin (first resin:second resin) is in a range of about 1:9 to 9:1, such as about 1:4 to 4:1, such as about 1:3 to 3:1, or about 1:2 to 2:1. In an embodiment, the first and second phenolic resole resins are present in a different ratio to each other than in the first polymeric composition.

The second polymeric composition can further comprise, if desired, a filler material in an amount of 0 wt % to 50 wt % of the weight of the second polymeric composition. In an embodiment, the second polymeric composition comprises a filler in an amount from 1 wt % to 50 wt %, such as about 10 wt % to 45 wt %, about 15 wt % to 40 wt %, or about 20 wt % to 35 wt %. In an embodiment, the filler can comprise calcium carbonate, wollastonite, clay, or a combination thereof.

In an embodiment, the uncured front fill composition can comprise:

15 wt % to 26 wt % of a first phenolic resole resin;
35 wt % to 52 wt % of a second phenolic resole resin;
25 wt % to 40 wt % of a filler; and
0 wt % to 5 wt % water, wherein the percentages are based on a total weight of the front fill composition and all the percentages of the ingredients add up to 100 wt %. Optionally, from about 0.1 wt % to about 5 wt % of additives can also be added to the front fill composition. If one or more additives are included, the amount of the other ingredients can be adjusted so that the total amounts of the ingredients in the front fill composition add up to 100 wt %.

In an embodiment, the cured second polymeric composition can comprise:

17 wt % to 28 wt % of a first phenolic resole resin;
35 wt % to 54 wt % of a second phenolic resole resin; and
27 wt % to 40 wt % of a filler; wherein the percentages are based on a total weight of the front fill composition and all the percentages of the ingredients add up to 100 wt %. Optionally, from about 0.1 wt % to about 5 wt % of additives can also be added to the front fill composition. If one or more additives are included, the amount of the other ingredients can be adjusted so that the total amounts of the ingredients in the front fill composition adds up to 100 wt %.

The dry add-on weight of the second polymeric composition refers to the amount of cured second polymeric composition disposed on the first side of the polymer impregnated nonwoven fabric. The dry add-on weight of the second polymeric composition to the nonwoven fabric can be in a particular range. In an embodiment, the dry add-on weight of the second polymeric composition can be not less than 5 g/m2 (GSM), such as not less than 10 GSM, not less than 15 GSM, not less than 20 GSM, not less than 25 GSM, not less than 30 GSM, not less than 35 GSM, not less than 40 GSM, or not less than 50 GSM. In another embodiment, the dry add-on weight of the second polymeric composition can be not greater than 200 GSM, such as not greater than 175 GSM, not greater than 150 GSM, not greater than 125 GSM, not greater than 100 GSM, not greater than 90 GSM, not greater than 80 GSM, or not greater than 70 GSM. The dry add-on weight of the second polymeric composition can be within a range comprising any pair of the previous upper and lower limits. In a particular embodiment, the dry add-on weight of the second polymeric composition can be in a range of not less than 5 GSM to not greater than 200 GSM, such as 20 GSM to 175 GSM, such as 30 GSM to 125 GSM, or 40 GSM to 100 GSM.

Backfill Layer

As stated above, the composite backing material comprises a polymer impregnated nonwoven fabric having a back fill layer disposed on a second side of the polymer impregnated nonwoven fabric. The back fill layer comprises a third polymeric composition (also called herein the back fill composition). The third polymeric composition can be the same as or different from the first polymeric composition or the second polymeric compositions as described above. The third polymeric composition can comprise an acrylic latex resin. The third polymeric composition can further comprise a phenolic resole resin. The phenolic resole resin can be single phenolic resole resin, or a mixture of a plurality of phenolic resole resins. The phenolic resole resin can be the same as or different from the first and second phenolic resole resins described above with respect to the first polymeric composition and the second polymeric composition. The third polymeric composition can further comprise a filler. The filler can be the same as or different from the filler of the second polymeric composition.

In an embodiment, the uncured third polymeric composition can comprise:

35 wt % to 55 wt % of an acrylic latex;

10 wt % to 20 wt % of a phenolic resole resin;

20 wt % to 30 wt % of a filler; and 0 wt % to 20 wt % water, wherein the percentages are based on a total weight of the third polymeric composition and all the percentages of the ingredients add up to 100 wt %. Optionally, from about 0.1 wt % to about 5 wt % of additives can also be added to the third polymeric composition. If one or more additives are included, the amount of the other ingredients can be adjusted so that the total amounts of the ingredients in the third polymeric composition add up to 100 wt %.

In an embodiment, the cured third polymeric composition can comprise:

40 wt % to 62 wt % of an acrylic latex;

12 wt % to 20 wt % of a phenolic resole resin; and 25 wt % to 40 wt % of a filler, wherein the percentages are based on a total weight of the third polymeric composition and all the percentages of the ingredients add up to 100 wt %. Optionally, from about 0.1 wt % to about 5 wt % of additives can also be added to the third polymeric composition. If one or more additives are included, the amount of the other ingredients can be adjusted so that the total amounts of the ingredients in the third polymeric composition add up to 100 wt %.

In an embodiment, the phenolic resole resin of the third polymeric composition is a third phenolic resole resin that is different than the phenolic resole resins of the first polymeric composition or the second polymeric composition. In an embodiment, the third phenolic resole resin can comprise a phenolic resin having an F/P ratio in a range of 1.9 to 2.2, a gel time at 121° C. in a range of 7-11 minutes; and a water tolerance in a range of 150 to 300%.

The dry add-on weight of the third polymeric composition refers to the amount of cured third polymeric composition disposed on the second side of the polymer impregnated nonwoven fabric. The dry add-on weight of the third polymeric composition can be in a particular range. In an embodiment, the dry add-on weight of the third polymeric composition can be not less than 5 g/m2 (GSM), such as not less than 10 GSM, not less than 15 GSM, not less than 20 GSM, not less than 25 GSM, not less than 30 GSM, not less than 35 GSM, not less than 40 GSM, not less than 50 GSM, or not less than 60 GSM. In another embodiment, the dry add-on weight of the third polymeric composition can be not greater than 200 GSM, such as not greater than 180 GSM, not greater than 170 GSM, not greater than 160 GSM, not greater than 150 GSM, not greater than 140 GSM, not greater than 130 GSM, not greater than 120 GSM, not greater than 110 GSM, or not greater than 100 GSM. The dry add-on weight of the third polymeric composition can be within a range comprising any pair of the previous upper and lower limits. In a particular embodiment, the dry add-on weight of the third polymeric composition can be in a range of not less than 5 GSM to not greater than 200 GSM, such as 30 GSM to 150 GSM, such as 40 GSM to 120 GSM, or 60 GSM to 100 GSM.

Composite Backing Material

The composite backing material can be described on a percent weight basis of the nonwoven backing material, the cured first polymeric composition, the cured front fill composition, and the cured third polymeric composition. In an embodiment, a completed composite backing material can comprise:

35 wt % to 45 wt % nonwoven fabric;

40 wt % to 50 wt % cured first polymeric composition;

2 wt % to 10 wt % cured second composition (front fill); and 3 wt % to 15 wt % cured third polymeric composition (back fill), wherein the percentages are based on the total weight of the composite backing material and all the percentages of the components add up to 100 wt %.

Beneficial Properties of a Composite Backing Material

The fully cured composite backing material possesses physical properties that are surprisingly beneficial and that contribute to superior abrasive performance of an abrasive article that includes the composite backing material.

Tensile strength in the machine direction (M/D) can be measured using an Instron 5982 with a 2 kN load cell. The composite backing material samples had a total sample length of 200 mm, a sample width of 25 mm, a gauge length of 127 mm, and were tested at a deformation rate of 300 mm/min. In an embodiment, the composite backing material can have a tensile strength in the machine direction (M/D) in a range 60 Kg/25 mm to 160 Kg/25 mm, such as 65 Kg/25 mm to 150 Kg/25 mm, 70 Kg/25 mm to 140 Kg/25 mm, 75 Kg/25 mm to 130 Kg/25 mm, 80 Kg/25 mm to 120 Kg/25 mm, or 85 Kg/25 mm to 115 Kg/25 mm. The tensile strength in the machine direction can be within a range comprising any pair of the previous upper and lower limits.

Tensile strength in the cross-direction (C/D) can be measured using an Instron 5982 with a 2 kN load cell. The composite backing material samples had a total sample length of 200 mm, a sample width of 25 mm, a gauge length of 127 mm, and were tested at a deformation rate of 300 mm/min. In an embodiment, the composite backing material can have a tensile strength in the cross direction (C/D) in a range of 40 Kg/25 mm to 120 Kg/25 mm, such as 45 Kg/25 mm to 110 Kg/25 mm, 50 Kg/25 mm to 100 Kg/25 mm, or 55 Kg/25 mm to 95 Kg/25 mm. The tensile strength in the cross direction can be within a range comprising any pair of the previous upper and lower limits.

Flexural Modulus in the machine direction (M/D) can be measured using an Instron 5966 with a 10 KN load cell. The composite backing material samples had a total sample length of 10 cm, a sample width of 1 inch mm, a gauge length of 127 mm, and were tested at a deformation rate of 1 mm/min (flexural grip used: three point bending), with the test based on ASTM D-790. In an embodiment, the flexural modulus in the machine direction for the composite backing material is in a range of about 0.8 GPa to 7 GPa, such as 0.9 GPa to 6 GPa, 1 GPa to 5 GPa, 1.1 GPa to 4 GPa, 1.2 GPa to 3.5 GPa, or 1.3 GPa to 3 GPa. The flexural modulus in the machine direction can be within a range comprising any pair of the previous upper and lower limits.

Flexural Modulus in the cross direction (C/D) can be measured using an Instron 5966 with a 10 KN load cell. The composite backing material samples had a total sample length of 10 cm, a sample width of 1 inch mm, a gauge length of 127 mm, and were tested at a deformation rate of 1 mm/min (flexural grip used: three point bending), with the test based on ASTM D-790. In an embodiment, the flexural modulus in the cross direction for the composite backing material is in a range of about 0.2 GPa to 5 GPa, such as 0.3 GPa to 4 GPa, 0.4 GPa to 3 GPa, 0.5 GPa to 2.5 GPa, 0.6 GPa to 2 GPa, or 0.7 GPa to 1.5 GPa. The flexural modulus in the cross direction can be within a range comprising any pair of the previous upper and lower limits.

Load deformation response (i.e., a measure of the maximum load before failure) of the composite backing material can be measured at various temperatures, such as elevated temperatures generated during abrasive operation in comparison to room temperature (about 25° C.). Load deformation response is measured according to the same method used to derive the tensile strength properties of the composite backing, except that the Instron testing machine is equipped with an in situ furnace that heats the material samples at a rate of 10 degrees ° C. per minute up to the desired testing temperature (e.g., 100° C. and 130° C.). Ideally, a load deformation response at an elevated temperature compared to room temperature would comprise a percent decrease of zero (i.e., no loss of load capacity at the elevated temperature); however, actual deformation responses comprise a non-zero percent decrease. Surprisingly and beneficially, Applicants have discovered that the present embodiments comprise a percent decrease of less than 40% at elevated temperatures experienced during actual grinding.

In an embodiment, the load deformation response of a composite backing material at 100° C. compared to room temperature can comprise a percent decrease of less than 40%, such as less than 39%, less than 38%, less than 37%, less than 35%%, less than 30%, less than 20%, less than 10%, less than 9%, less than 8%, less than 7%, less than 6%, less than 5%, less than 4%, less than 3%, less than 2%, or less than 1.5%. Still, the load deformation response at 100° C. is measurable, such that in an embodiment, the load deformation response of a composite backing material at 100° C. compared to room temperature is greater than 0.1%, such as greater than 0.5%, or greater than 1%. The load deformation response of the composite backing material at 100° C. compared to room temperature can be in a range a range comprising any pair of the previous upper and lower limits. In a particular embodiment, the load deformation response of the composite backing material at 100° C. compared to room temperature is a percent decrease in a range of 1.44% to 39%.

In another embodiment, the load deformation response of a composite backing material at 130° C. compared to room temperature was a percent decrease of less than 60%, such as less than 50%, less than 40, less than 30%, less than 20%, less than 19%, less than 18%, less than 17%, less than 16%, or even less than 15.5%. In an embodiment, the load deformation response of a composite backing material at 130° C. compared to room temperature was a percent decrease of not less than 15.1%. Still, the load deformation response at 130° C. is measurable, such that in an embodiment, the load deformation response of a composite backing material at 130° C. compared to room temperature is greater than 1%, such as greater than 5%, greater than 10%, or greater than 15%. The load deformation response of the composite backing material at 130° C. compared to room temperature can be in a range a range comprising any pair of the previous upper and lower limits. In a particular embodiment, the load deformation response of the composite backing material at 130° C. compared to room temperature is a percent decrease in a range of 60% to 15.1%.

Applicants discovered that it is surprising and particularly beneficial that the deformation load response at elevated temperatures is such a small percent decrease in comparison to conventional vulcanized fiber backing material. For example, conventional vulcanized fiber backings have a deformation response at 100° C. compared to room temperature of at least a 40% decrease (compared to only a 1.44% decrease for an inventive sample), and a deformation response at 130° C. compared to room temperature of at least a 66% percent decrease (compared to only a 15.1% decrease for an inventive sample). (See FIGS. 13-15). Applicants further point out that inventive samples at 130° C. surprisingly and beneficially actually have a maximum load that exceeds the maximum load for conventional vulcanized fiber samples.

The composite backing material, and abrasive article embodiments that include the composite backing material, can have a particular moisture resistance and dimensional stability under certain temperature and relative humidity conditions. Applicants have discovered that the composite backing material embodiments, and abrasive article embodiments that include the composite backing material embodiments, have surprisingly beneficial moisture resistance and dimensional stability (i.e., weight stability and resistance to changes in dimension, such as resistance to warping, curling, and cupping) as measured under certain temperature and relative humidity conditions.

In an embodiment, abrasive articles placed in a climate chamber at a temperature of 50° C. and 25% relative humidity (RH) for 2.5 hours, can have a % weight gain of less than 5.5%, such as less than 5%, less than 4%, less than 3%, less than 2%, even less than 1.5%. Ideally, an abrasive article can have no weight gain (i.e., a gain of 0%), however, typically an abrasive disc will have some weight gain greater than zero percent, such as greater than 0.1%, greater than 0.2%, greater than 0.3%, greater than 0.4%, greater than 0.5%, greater than 0.6%, greater than 0.7%, greater than 0.8%, greater than 0.9%, or greater than 1.0%. The weight gain of the abrasive article at 50° C. and 25% RH can be in a range comprising any pair of the previous upper and lower limits. In a particular embodiment, the weight gain of the abrasive article at 50° C. and 25% RH is in a range of 0.1% to 5%, such as 0.5% to 4.5%. (See FIG. 18)

In another embodiment, abrasive articles placed in a climate chamber at a temperature of 35° C. and 85% relative humidity (RH) for 2.5 hours, can have a % weight gain of less than 2.25%, such as less than less than 2%, less than 1%, or even less than 0.5%. Ideally, an abrasive article can have no weight gain (i.e., a gain of 0%), however, typically an abrasive disc will have some weight gain greater than zero percent, such as greater than 0.1%, greater than 0.2%, or greater than 0.3%. The weight gain of the abrasive article at 35° C. and 85% RH can be in a range comprising any pair of the previous upper and lower limits. In a particular embodiment, the weight gain of the abrasive article at 35° C. and 85% RH is in a range of 0.1% to 2.25%, such as 0.2% to 2%. (See FIG. 21)

In an embodiment, abrasive articles placed in a climate chamber at a temperature of 50° C. and 25% relative humidity (RH) for 2.5 hours can have a "three-point dimensional stability" determined by selecting three points on the surface of the abrasive disc: point 1 at the left edge of the disc; point 2 at the edge of the center hole of the disc; and point 3 at the right edge of the disc (See FIG. 17A-F) and recording their vertical distance while the disc is lying flat prior to being placed in the climate chamber and after being placed in the climate chamber for the specified period of time. The difference in vertical distance for the selected points can be used to calculate the change in dimension as a percent difference for each point. In an embodiment, the dimensional stability is a function of all three points. In an embodiment, an abrasive article can have a three-point dimensional stability at 50° C. and 25% RH where all three points have a percent (%) change in dimension of less than 700%, such as less than 600%, less than 500%, less than 400%, less than 300%, less than 200%, less than 100%, less than 50%, even less than 25%. Ideally, an abrasive article can have no change in three-point dimensional stability (i.e., a percent change of 0%), however, typically an abrasive article will have a change of three-point dimensional stability at 50° C. and 25% RH for all three points greater than zero percent for each point, such as greater than 0.1%, greater than 1%, greater than 2%, greater than 3%, greater than 5%, greater than 8%, greater than 10%, greater than 12%, greater than 14%, or greater than 15%. The three-point dimensional stability at 50° C. and 25% RH for all three points can be in a range comprising any pair of the previous upper and lower limits. In a particular embodiment, an abrasive article can have a three-point dimensional stability at 50° C. and 25% RH where the % difference in dimension for all three points is in a range of 0.1% to 700%, such as 1% to 650%. (See FIG. 19)

In another embodiment, abrasive articles placed in a climate chamber at a temperature of 35° C. and 85% relative humidity (RH) for 2.5 hours can have a "three-point dimensional stability" determined by selecting three points on the surface of the abrasive disc: point 1 at the left edge of the disc; point 2 at the edge of the center hole of the disc; and point 3 at the right edge of the disc (See FIG. 20A-F) and recording their vertical distance while the disc is laying flat prior to being placed in the climate chamber and after being placed in the climate chamber for the specified period of time. The difference in vertical distance for the selected points can be used to calculate the change in dimension as a percent difference for each point. In an embodiment, the dimensional stability is a function of all three points. In an embodiment, an abrasive article can have a three-point dimensional stability at 35° C. and 85% RH where all three points have a % change in dimension of less than 75%, such as less than 70%, less than 65%, less than 60%, less than 55%, less than 50%, less than 45%, less than 40%, less than 35%, less than 30%, or even less than 25%. Ideally, an abrasive article can have no change in three-point dimensional stability (i.e., a percent change of 0%), however, typically an abrasive article will have a change of three-point dimensional stability at 35° C. and 85% RH for all three points greater than zero percent for each point, such as greater than 0.1%, greater than 1%, greater than 2%, greater than 3%, greater than 5%, greater than 8%, greater than 10%, greater than 12%, greater than 14%, or greater than 15%. The three-point dimensional stability at 35° C. and 85% RH for all three points can be in a range comprising any pair of the previous upper and lower limits. In a particular embodiment, an abrasive article can have a three-point dimensional stability at 35° C. and 85% RH where the % difference in dimension for all three points is in a range of 0.1% to 75%, such as 1% to 70%. (See FIG. 22)

Method of Making a Composite Backing Material

Mixing a First Polymeric Composition

A first polymeric composition can comprise a polymeric composition as described above. The ingredients of the first polymeric composition are thoroughly mixed together. Mixing can be conducted using high shear conditions, moderate shear conditions, low shear conditions, or combinations thereof. Typically, mixing occurs until the ingredients are thoroughly mixed.

During mixing of the first polymeric composition, the ingredients can be added to the first polymeric composition one by one, in batches, or all at once. Typically the ingredients are added one by one to the first polymeric composition. If the ingredients are added one by one or in batches, the first polymeric composition can be agitated for a period of time until the ingredient has sufficiently mixed into the first polymeric composition. Typical agitation times range from about 1 minute to about 2 hours, depending on the ingredient or ingredients being added to the first polymeric composition.

The temperature of the first polymeric composition can be adjusted if desired during mixing. The temperature of the first polymeric composition during mixing can be in a range of about 15° C. to about 45° C., such as about 20° C. to about 25° C. The pH of the first polymeric composition can be adjusted during mixing. The pH can be adjusted by the addition of an acid, a base, a buffer solution, or a combination thereof if desired. The pH of the first polymeric composition is typically basic, but can be close to neutral, such as in a range of about 7 pH to about 13 pH.

Water can be added to the first polymeric composition in an amount to adjust or control the viscosity of the first polymeric composition as desired. The viscosity of the first polymeric composition can be monitored as it is being prepared. In an embodiment, the viscosity of the first polymeric composition is adjusted to be within a particular range. In an embodiment, the viscosity of the first polymeric composition is in a range of about 10 cps to about 300 cps, such as about 50 cps to about 250 cps, or about 75 cps to about 200 cps based on the addition of water to the first polymeric composition.

Saturating the Nonwoven Fabric

A suitable nonwoven fabric, such as described above, can be saturated (also referred to herein as being "impregnated") with first polymeric composition by any suitable manner that applies a sufficient amount of first polymeric composition so that the nonwoven fabric becomes thoroughly soaked with the first polymeric composition. In an embodiment, saturation can be accomplished by dipping, spraying, submerging, coating, or washing the nonwoven fabric with or in the first polymeric composition, or combinations thereof. The saturation can occur as a single step or multiple steps, such as multiple dipping steps or multiple spraying steps of the nonwoven fabric with the first polymeric composition, or combinations thereof. In a specific embodiment, the nonwoven fabric is dipped into a first polymeric composition. In another embodiment a nonwoven fabric is sprayed with a first polymeric composition.

Adjusting Saturation

Adjusting the saturation of the first polymeric composition can be accomplished by any method or mechanism that does not overly degrade the nonwoven fabric. Suitable methods and mechanisms of adjusting the first polymeric composition can re-apply and/or remove a desired amount of first polymeric composition so that the nonwoven fabric has a desired amount of saturation. Adjusting the amount of first polymeric composition can be accomplished in a single step or multiple steps. Adjusting the amount of first polymeric composition can include pressing, squeezing, brushing, squeegeeing, blowing, dabbing, blotting, rollering, shaking, or combinations thereof, and the like. In a specific embodiment, the polymer impregnated nonwoven fabric can be squeezed, such as between a pair of rollers to adjust the saturation of the saturated backing material.

Curing

After saturation of the nonwoven fabric with first polymeric composition, and any optional adjustment of the amount of saturation of the backing material, the saturated or saturation adjusted pre-cure nonwoven fabric can undergo curing, partially to fully, to form a composite backing material (i.e., The polymer impregnated nonwoven fabric has been impregnated with cured polymeric saturation composition). Curing can be conducted in a single step or multiple steps. Curing can be accomplished by exposure to a heat source, such as a heating tunnel or oven, including a multi stage oven, or the like. Alternative heating sources can include exposure to infrared radiation lamps, or the like.

In an embodiment, the polymer impregnated nonwoven fabric is cured at a particular temperature or temperature range. The add-on amino or phenolic resin saturating the nonwoven fabric is cured. In an embodiment, the curing temperature is at least about 95° C., such as at least about 100° C., such as at least about 110° C., or at least about 125° C. In an embodiment, the curing temperature is not greater than about 175° C., such as not greater than about 170° C., not greater than about 165° C., not greater than about 160° C., not greater than about 155° C., or not greater than about 150° C. The curing temperature of the nonwoven fabric can be within a range comprising any pair of the previous upper and lower limits. In a particular embodiment, the curing temperature can be in the range of not less than 100° C. to about 150° C.

In accordance with an embodiment, the polymer impregnated nonwoven fabric can be cured to a particular degree (i.e., the first polymeric composition saturating the backing material is cured to a particular degree). In an embodiment, the polymer impregnated nonwoven fabric can be partially cured or completely cured. In an embodiment, the polymer impregnated nonwoven fabric is partially cured. In an embodiment, the polymer impregnated nonwoven fabric is partially cured not greater than 95%, such as not greater than 90%, not greater than 80%, not greater than 70%, not greater than 60%, not greater than 55%, or not greater than 50%. In an embodiment, the polymer impregnated nonwoven fabric is partially cured not less than 5%, such as not less than 10%, not less than 20%, not less than 30% or not less than 35%. The amount of partially curing the polymer impregnated nonwoven fabric can be within a range comprising any pair of the previous upper and lower limits. In a particular embodiment, the polymer impregnated nonwoven fabric is partially cured not greater than 95% and not less than 5%, such not greater than 60% and not less than 20%, or not greater than 50% and not less than 30%.

In another embodiment, the polymer impregnated nonwoven fabric can be cured to a degree that the surface of the partially cured nonwoven fabric is rendered tack free (i.e., not tacky, does not stick to fingers), but the partially cured fabric is still pliable and suitable for further processing.

Partially to fully curing the polymer impregnated nonwoven fabric forms a completed polymer impregnated nonwoven fabric.

Applying the Front Fill Layer

A second polymeric composition (front fill composition) as described above can be prepared by mixing together the required ingredients. The ingredients of the second polymeric composition are thoroughly mixed together. Mixing shear conditions, addition of ingredients, mixing temperature, and pH range of the composition are as described above with respect to the first polymeric composition.

Water can be added to the second polymeric composition in an amount to adjust or control the viscosity of the second polymeric composition as desired. The viscosity of the second polymeric composition can be monitored as it is being prepared. In an embodiment, the viscosity of the second polymeric composition is adjusted to be within a particular range. In an embodiment, the viscosity of the second polymeric composition is in a range of about 900 cps to about 2000 cps, such as about 1000 cps to about 1900 cps, about 1100 cps to about 1800 cps, or about 1200 cps to about 1700 cps based on the addition of water to the second polymeric composition.

The front fill layer can be applied to a first side of the polymer impregnated nonwoven fabric by any suitable coating method or coating apparatus. Suitable coating apparatus can include a drop die coater, a knife coater, a curtain coater, a die coater, or a vacuum die coater. Coating methodologies can include either contact or non-contact coating methods. Suitable coating methods can include two roll coating, three roll reverse coating, knife over roll coating, slot die coating, gravure coating, rotary printing, extrusion, spray coating, or combinations thereof.

Curing the Front Fill Layer

The second polymeric composition can be cured partially to fully in the same manner as described above with respect the first polymer composition. In a particular embodiment, the second polymeric composition is partially cured to not greater than 60% and not less than 20%. In a particular embodiment, the second polymeric composition curing temperature is in a range of not less than 100° C. to about 150° C.

Calendaring the Front Fill Layer

The front fill layer can optionally be processed to smooth the surface of the front fill layer. The front fill layer can be smoothed by any known acceptable process. In an embodiment, calendaring of the front fill layer is performed.

Applying the Back Fill Layer

A third polymeric composition (back fill composition) as described above can be prepared by mixing together the required ingredients. The ingredients of the third polymeric composition are thoroughly mixed together. Mixing shear conditions, addition of ingredients, mixing temperature, and pH range of the composition are as described above with respect to the first polymeric composition.

Water can be added to the third polymeric composition in an amount to adjust or control the viscosity of the second polymeric composition as desired. The viscosity of the third polymeric composition can be monitored as it is being prepared. In an embodiment, the viscosity of the third polymeric composition is adjusted to be within a particular range. In an embodiment, the viscosity of the second polymeric composition is in a range of about 900 cps to about 2000 cps, such as about 1000 cps to about 1900 cps, about 1100 cps to about 1800 cps, or about 1200 cps to about 1700 cps based on the addition of water to the third polymeric composition.

The back fill layer can be applied to a second side of the polymer impregnated nonwoven fabric by any suitable coating method or coating apparatus. Suitable coating apparatus can include a drop die coater, a knife coater, a curtain coater, a die coater, or a vacuum die coater. Coating methodologies can include either contact or non-contact coating methods.

Suitable coating methods can include two roll coating, three roll reverse coating, knife over roll coating, slot die coating, gravure coating, rotary printing, extrusion, spray coating, or combinations thereof.

Curing the Back Fill Layer

The third polymeric composition can be cured partially to fully in the same manner as described above with respect the first polymer composition. In a particular embodiment, the third polymeric composition is partially cured to not greater than 60% and not less than 20%. In a particular embodiment, the third polymeric composition curing temperature is in a range of not less than 100° C. to about 150° C. Upon completion of the curing of the back fill layer the composite backing material is complete. The composite backing material can be stored or subjected to additional processing such as is required to construct a coated abrasive article.

Calendaring the Back Fill Layer

The back fill layer can optionally be processed to smooth the surface of the back fill layer. The back fill layer can be smoothed by any known acceptable process. In an embodiment, calendaring of the back fill layer is performed.

Preparation of a Coated Abrasive

The composite backing material can be used to make a coated abrasive article. In an embodiment, an abrasive layer is disposed on the composite backing material. Optionally, a size coat, a supersize coat, a back coat or any other number of compliant or intermediary layers known in the art of making a coated abrasive article can be applied to the amino or phenolic resin treated backing to construct a coated abrasive article.

Abrasive Layer

An abrasive layer can comprise a make coat or an abrasive slurry. The make coat or abrasive slurry can comprise a plurality of abrasive particles, also referred to herein as abrasive grains, retained by a polymer binder composition. The polymer binder composition can be an aqueous composition. The polymer binder composition can be a thermosetting composition, a radiation cured composition, or a combination thereof.

Abrasive Grains

Abrasive grains can include essentially single phase inorganic materials, such as alumina, silicon carbide, silica, ceria, and harder, high performance superabrasive grains such as cubic boron nitride and diamond. Additionally, the abrasive grains can include composite particulate materials. Such materials can include aggregates, which can be formed through slurry processing pathways that include removal of the liquid carrier through volatilization or evaporation, leaving behind green aggregates, optionally followed by high temperature treatment (i.e., firing) to form usable, fired aggregates. Further, the abrasive regions can include engineered abrasives including macrostructures and particular three-dimensional structures.

In an exemplary embodiment, the abrasive grains are blended with the binder formulation to form abrasive slurry. Alternatively, the abrasive grains are applied over the binder formulation after the binder formulation is coated on the backing. Optionally, a functional powder can be applied over the abrasive regions to prevent the abrasive regions from sticking to a patterning tooling. Alternatively, patterns can be formed in the abrasive regions absent the functional powder.

The abrasive grains can be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains can be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive grains comprised principally of alpha-alumina.

The abrasive grain can also have a particular shape. An example of such a shape includes a rod, a triangle, a pyramid, a cone, a solid sphere, a hollow sphere, or the like. Alternatively, the abrasive grain can be randomly shaped.

In an embodiment, the abrasive grains can have an average grain size not greater than 800 microns, such as not greater than about 700 microns, not greater than 500 microns, not greater than 200 microns, or not greater than 100 microns. In another embodiment, the abrasive grain size is at least 0.1 microns, at least 0.25 microns, or at least 0.5 microns. In another embodiment, the abrasive grains size is from about 0.1 microns to about 200 microns and more typically from about 0.1 microns to about 150 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

Binder—Make Coat or Abrasive Slurry Coat

The binder of the make coat or the size coat can be formed of a single polymer or a blend of polymers. For example, the binder can be formed from epoxy, acrylic polymer, or a combination thereof. In addition, the binder can include filler, such as nano-sized filler or a combination of nano-sized filler and micron-sized filler. In a particular embodiment, the binder is a colloidal binder, wherein the formulation that is cured to form the binder is a colloidal suspension including particulate filler. Alternatively, or in addition, the binder can be a nanocomposite binder including sub-micron particulate filler.

The binder generally includes a polymer matrix, which binds abrasive grains to the backing or compliant coat, if present. Typically, the binder is formed of cured binder formulation. In one exemplary embodiment, the binder formulation includes a polymer component and a dispersed phase.

The binder formulation can include one or more reaction constituents or polymer constituents for the preparation of a polymer. A polymer constituent can include a monomeric molecule, a polymeric molecule, or a combination thereof. The binder formulation can further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents can include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation can include a monomer, an oligomer, a polymer, or a combination thereof. In a particular embodiment, the binder formulation includes monomers of at least two types of polymers that when cured can crosslink. For example, the binder formulation can include epoxy constituents and acrylic constituents that when cured form an epoxy/acrylic polymer.

Size Coat

The coated abrasive article can comprise a size coat overlying the abrasive layer. The size coat can be the same as or different from the polymer binder composition used to form the abrasive layer. The size coat can comprise any conventional compositions known in the art that can be used as a size coat. In an embodiment, the size coat comprises a conventionally known composition overlying the polymer binder composition of the abrasive layer. In another embodiment, the size coat comprises the same ingredients as the polymer binder composition of the abrasive layer. In a specific embodiment, the size coat comprises the same ingredients as the polymer binder composition of the abrasive layer and one or more hydrophobic additives. In a specific embodiment, the hydrophobic additive can be a wax, a halogenated organic compound, a halogen salt, a metal, or a metal alloy.

Supersize Coat

The coated abrasive article can comprise a supersize coat overlying the size coat. The supersize coat can be the same as or different from the polymer binder composition or the size coat composition. The supersize coat can comprise any conventional compositions known in the art that can be used as a supersize coat. In an embodiment, the supersize coat comprises a conventionally known composition overlying the size coat composition. In another embodiment, the supersize coat comprises the same ingredients as at least one of the size coat composition or the polymer binder composition of the abrasive layer. In a specific embodiment, the supersize coat comprises the same composition as the polymer binder composition of the abrasive layer or the composition of the size coat plus one or more grinding aids.

Suitable grinding aids can be inorganic based; such as halide salts, for example sodium cryolite, and potassium tetrafluoroborate; or organic based, such as sodium lauryl sulphate, or chlorinated waxes, such as polyvinyl chloride. In an embodiment, the grinding aid can be an environmentally sustainable material.

Additives

Any of the various polymeric compositions used to form the composite backing material; namely the first polymeric composition (dip fill), second polymeric composition (front fill), and third polymeric composition (back fill); and the component layers of the coated abrasive article; namely the binder (as a make coat or slurry coat), the size coat composition, and the supersize composition can comprise one or more additives.

Suitable additives can include grinding aids, fibers, lubricants, wetting agents, thixotropic materials, surfactants, thickening agents, pigments, dyes, antistatic agents, coupling agents, plasticizers, suspending agents, pH modifiers, adhesion promoters, lubricants, bactericides, fungicides, flame retardants, degassing agents, anti-dusting agents, dual function materials, initiators, chain transfer agents, stabilizers, dispersants, reaction mediators, colorants, and defoamers. The amounts of these additive materials can be selected to provide the properties desired. These optional additives may be present in any part of the overall system of the coated abrasive product according to embodiments of the present disclosure.

Illustrated in FIG. 2 is an embodiment of a coated abrasive article 200, commonly called a "coated abrasive."

EXAMPLES

Example 1: Making a Composite Backing Material

A. Nonwoven Stitch Bonded Fabric

Several samples of nonwoven stitch bonded fabrics were obtained for forming inventive abrasive articles. The nonwoven stitch bonded fabrics were formed of 100% polyester interlocked web formed by a needling procedure using 0-15 mm penetration at a rate of about 10-50 stokes per unit area. The fiber of the nonwoven fabrics had fiber weight in a range of about 100 GSM to about 300 GSM (i.e., grams per square meter, or g/m2) as measured after the needling procedure. Three layers of nonwoven webs were then stitched together with stitch thread, alternating cross-laid and machine-laid nonwoven webs, to form a nonwoven stitch bonded fabric. The nonwoven stitch bonded fabric had a weight of 380 GSM, and a thickness of 1.0 mm to 2.0 mm.

The nonwoven stitch bonded fabric was then impregnated with a first polymeric composition prepared by mixing together the following ingredients:

1 part by weight low temperature (LT) phenolic resole
1 part by weight high temperature (HT) phenolic resole, and
water as needed to achieve a desired viscosity The water was added to the mixture of low temperature and high temperature phenolic resole and mixed to achieve a desired viscosity in a range of about 50 to 200 centipoise (cP).

The stitch bonded nonwoven fabric was impregnated with the first polymeric composition by submerging (dipping) the fabric in the first polymeric composition. The saturated fabric was subsequently passed through a pair of squeeze rollers to squeeze out excess first polymeric composition. The saturated fabric was passed through a heating tunnel to partially cure the first polymeric composition. The heating tunnel had several heating zones having a temperature in a ranging up to 180° C. and the residence time in the heating tunnel lasted from 2.0 hours to 4 hours. The polymer impregnated fabric was partially cured (i.e., not completely cured) to about 40% cured until so that it was no longer tacky to the touch but remained sufficiently flexible to be processed further.

A front fill composition was prepared by mixing together the following ingredients:

2 parts by weight low temperature phenolic resole
1 part by weight high temperature phenolic resole, 1.5 parts by weight calcium carbonate and
water as needed to maintain desired viscosity The water was added to the polymeric mixture to achieve a desired viscosity in a range of about 900 to 1700 centipoise (cP). The front fill composition was applied to a first side of the polymer impregnated nonwoven fabric by a roll coater machine and subsequently passed through a heating tunnel to partially cure the front fill composition. The heating tunnel had several heating zones having a temperature ranging up to 170° C. and the residence time in the heating tunnel lasted from 0.5 hours to 1.5 hours. The front fill composition was partially cured (i.e., not completely cured) to about 40%. After partially curing, the front fill composition was calendared and the polymer impregnated nonwoven fabric was then processed further.

A back fill composition was prepared by mixing together the following ingredients:

43.9 wt % acrylic latex resin
13.2 wt % phenolic resin,
0.2 wt % ammonia,
1.3 wt % thickener
0.2 wt % pigment
26.3 wt % calcium carbonate and
water as needed to maintain desired viscosity The water was added to the polymeric mixture to achieve a desired viscosity in a range of about 1300 to 2000 centipoise (cP). The back fill composition was applied to a second side of the polymer impregnated nonwoven fabric by a roll coater machine and subsequently passed through a heating tunnel to partially cure the back fill composition. The heating tunnel had several heating zones having a temperature in a range up to 170° C. and the residence time in the heating tunnel lasted from 0.5 hours to 1.5 hours. The back fill composition was partially cured (i.e., not completely cured) to about 40%. After partially curing, the back fill composition was calendared and thus the polymer impregnated nonwoven fabric was formed into a composite backing material. The composite backing material was then tested and samples of the composite backing material were processed further to make coated abrasive articles.

Example 2: Tensile Strength and Elongation Testing

Tensile strength testing and flexural modulus testing of comparative vulcanized fiber samples and inventive composite backing material samples was conducted.

Figure 6:
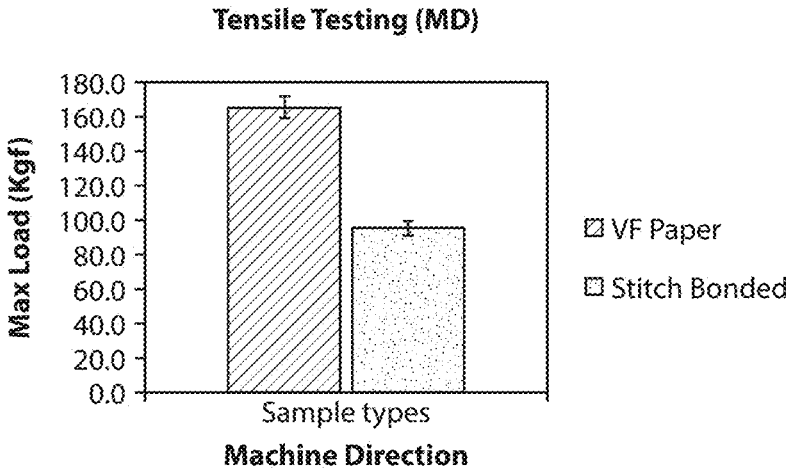
FIG. 6 is a graph comparing the tensile strength in the machine direction of an embodiment of a composite backing material sample with a conventional vulcanized fiber backing material.

Tensile strength in the machine direction (M/D) was measured using an Instron 5982 with a 2 kN load cell. The composite backing material samples had a total sample length of 200 mm, a sample width of 25 mm, a gauge length of 127 mm, and were tested at a deformation rate of 300 mm/min. The inventive sample had a tensile strength in the machine direction of slightly less than 100 Kgf/25 mm. The comparative sample had a tensile strength in the machine direction of just over 160 Kgf/25 mm. The results are shown in FIG. 6.

Figure 7:
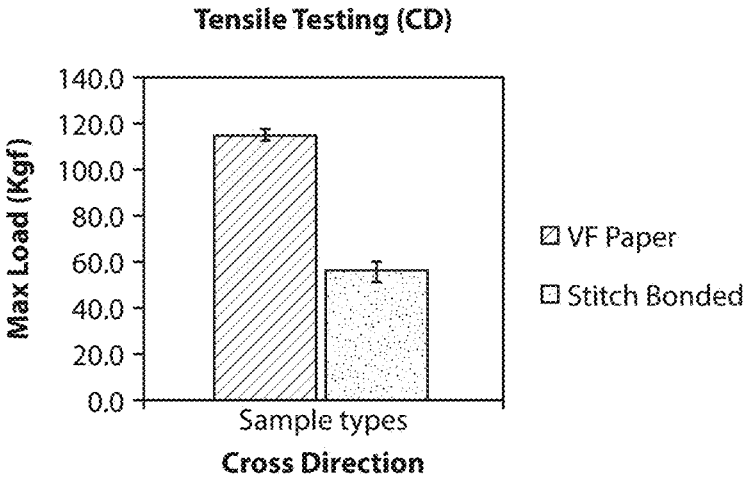
FIG. 7 is a graph comparing the tensile strength in the cross direction of an embodiment of a composite backing material sample with a conventional vulcanized fiber backing material.

Tensile strength in the machine direction (C/D) was measured using an Instron 5982 with a 2 kN load cell. The composite backing material samples had a total sample length of 200 mm, a sample width of 25 mm, a gauge length of 127 mm, and were tested at a deformation rate of 300 mm/min. The inventive sample had a tensile strength in the cross direction of slightly less than 60 Kgf/25 mm. The comparative sample had a tensile strength in the machine direction of just under 125 Kgf/25 mm. The results are shown in FIG. 7.

Figure 8:
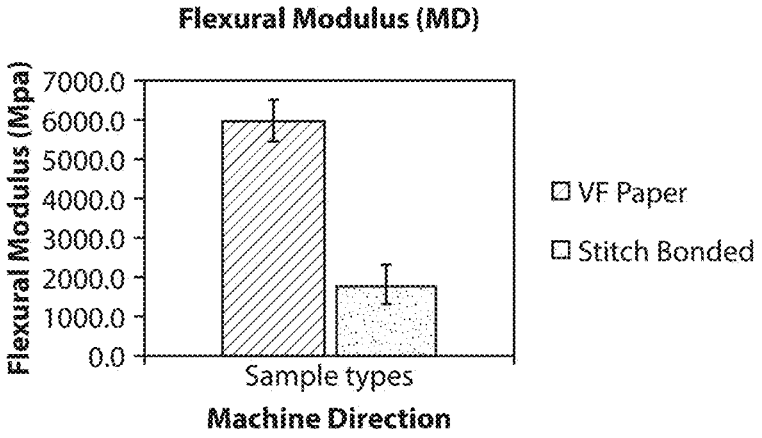
FIG. 8 is a graph comparing flexural modulus data in the machine direction of an embodiment of a composite backing material sample with a conventional vulcanized fiber backing material.

Flexural Modulus in the machine direction (M/D) was measured using an Instron 5966 with a 10 KN load cell. The composite backing material samples had a total sample length of 10 cm, a sample width of 1 inch mm, a gauge length of 127 mm, and were tested at a deformation rate of 1 mm/min (flexural grip used: three point bending), with the test based on ASTM D-790. The inventive sample had a flexural modulus in the machine direction of slightly less than 2 GPa. The comparative sample had a flexural modulus in the machine direction of just under 6 GPa. The results are shown in FIG. 8.

Figure 9:
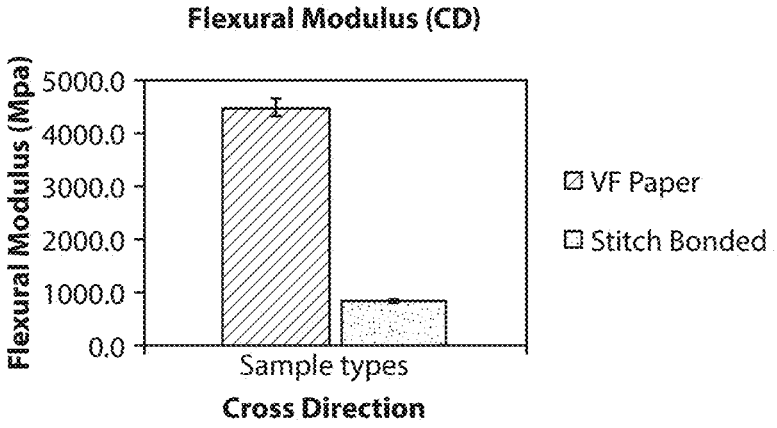
FIG. 9 is a graph comparing the flexural modulus data in the cross direction of an embodiment of a composite backing material sample with a conventional vulcanized fiber backing material.

Flexural Modulus in the cross direction (C/D) was measured using an Instron 5966 with a 10 KN load cell. The composite backing material samples had a total sample length of 10 cm, a sample width of 1 inch mm, a gauge length of 127 mm, and were tested at a deformation rate of 1 mm/min (flexural grip used: three point bending), with the test based on ASTM D-790. The inventive sample had a flexural modulus in the cross direction of slightly less than 1 GPa. The comparative sample had a flexural modulus in the cross direction of approximately 4.5 GPa. The results are shown in FIG. 9.

Example 3: Abrasive Disc Construction

Abrasive discs were prepared using the composite backing material samples prepared in Example 1. Comparative abrasive discs were prepared using conventional vulcanized fiber substrate. The only difference between the inventive and comparative abrasive discs was the backing material.

Example 4: Field Testing of Abrasive Discs—Teak Wood and Rose Wood

Abrasive testing of the abrasive discs prepared in Example 3 was conducted. Wooden furniture (teak wood and rose wood) was sanded according to the following conditions and procedure.

Application: Offhand sanding of wooden furniture.
Abrasive product: 4 or 5 inch abrasive disc samples (Aluminum oxide grain 80 grit or 120 grit)
Tool: 4 or 5 inch angle grinder with back up pad.
Work Piece: Furniture (Teak wood or rose wood).
Operational parameters: RPM 1200 max, off hand sanding on flat and curved surfaces.
Measured Parameters: Surface finish of workpiece was judged by visual inspection.

End of life of the abrasive disc occurred when the abrasive disc was dull or clogged with swarf such that it created observable burn marks on the wood. The number of wooden furniture pieces successfully abraded prior to end of life of the disc was recorded and used to estimate the approximate total volume of wood abraded.

The only difference between the inventive and the comparative samples was the backing material.

Figure 12:
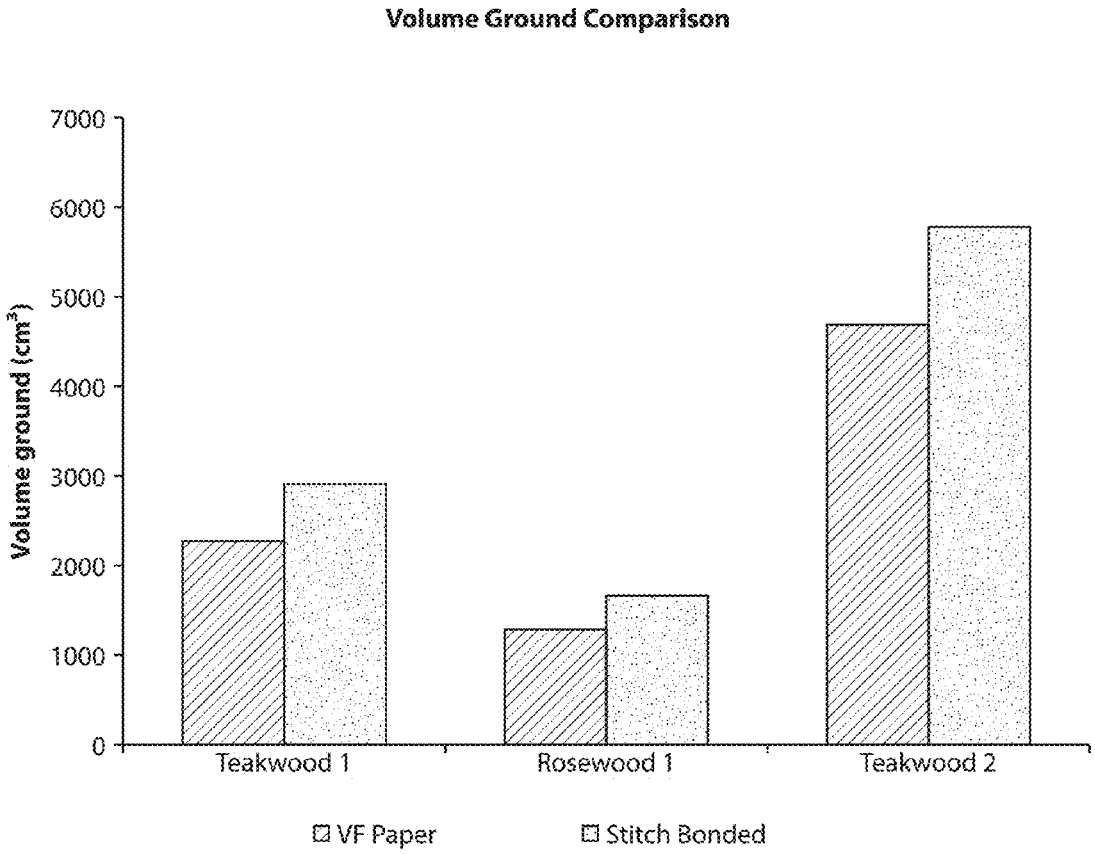
FIG. 12 is a bar graph comparing the amount of cumulative material removed by conventional vulcanized fiber discs and inventive abrasive discs from Teakwood and Rosewood workpieces.

The results of the abrasive testing are shown in FIG. 12. As shown in FIG. 12, inventive abrasive disc samples had a clearly higher volume of cumulative material removed ("volume ground") for both teakwood (Teakwood 1 and Teakwood 2) and rose wood (Rosewood 1) compared to the conventional vulcanized fiber discs.

Figure 10:
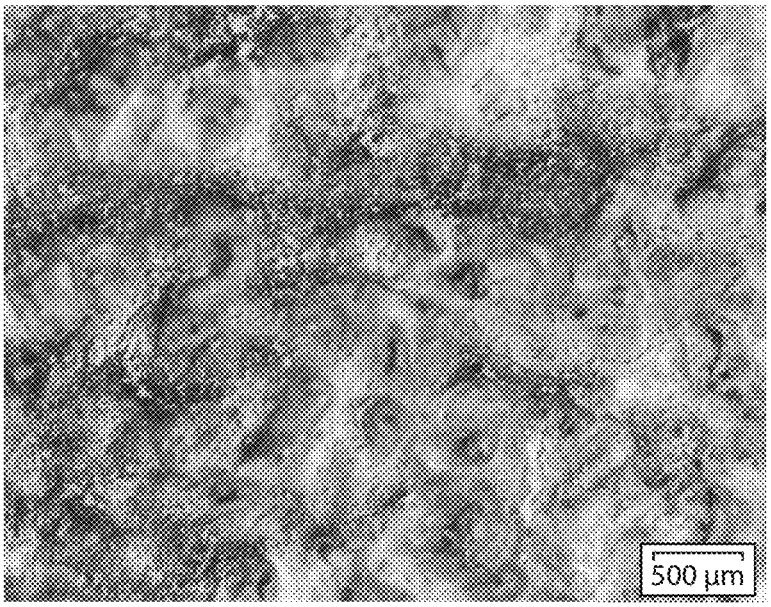
FIG. 10 is a photograph of a conventional coated abrasive disc having a vulcanized fiber substrate showing the disc at its end of life with dulled abrasive grains and clogged with swarf.
Figure 11:
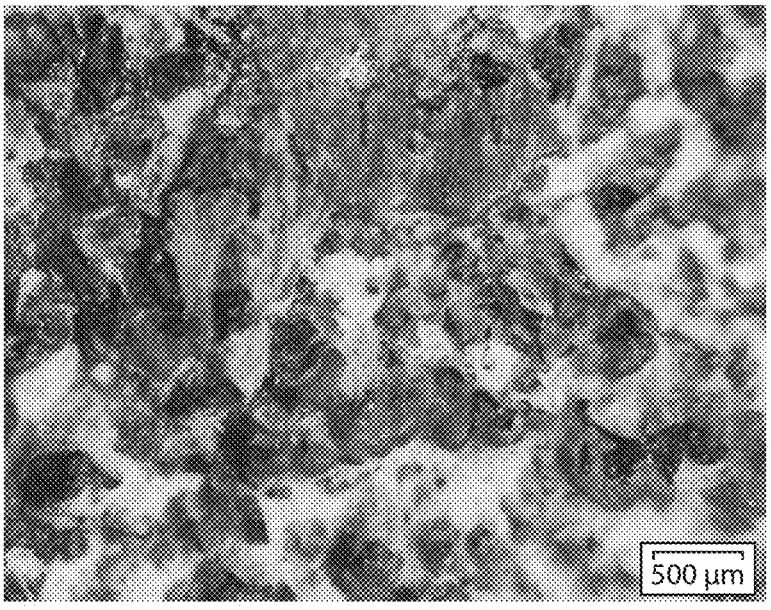
FIG. 11 is a photograph of an inventive coated abrasive disc embodiment that includes a composite backing showing that after grinding for the same amount of time as the conventional sample shown in FIG. 10, there is less accumulated swarf and there are still exposed abrasive grains for continued grinding.

It was observed that the conventional abrasive discs reached end of life after approximately 30 minutes of use. FIG. 10 is an image of the dull and swarf clogged surface of the conventional disc at end of useful life. In contrast, FIG. 11 is an image of an inventive abrasive disc at 30 minutes of use. The inventive disc does show wear, but there are still exposed abrasive grains available for further grinding and there is less swarf build-up. The inventive discs were able to be used for approximately 50 minutes before reaching end of life.

Example 5: Abrasive Article Load Deformation Testing

Figure 13:
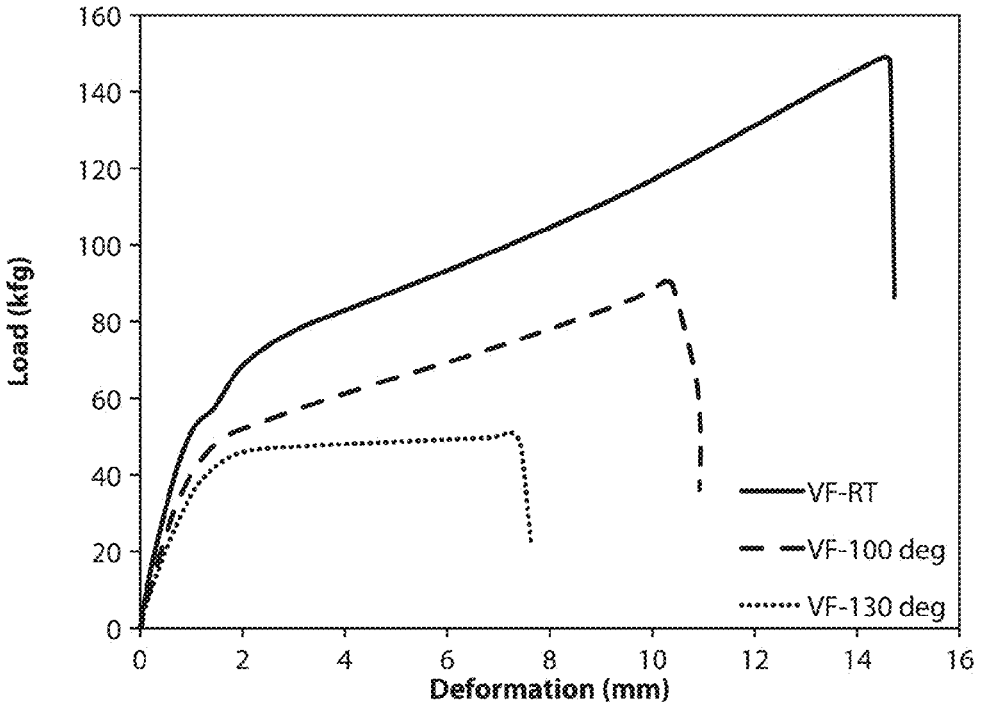
FIG. 13 is a graph showing the load-deformation response of a conventional vulcanized fiber abrasive disc at room temperature, 100° C., and 130° C.
Figure 14:
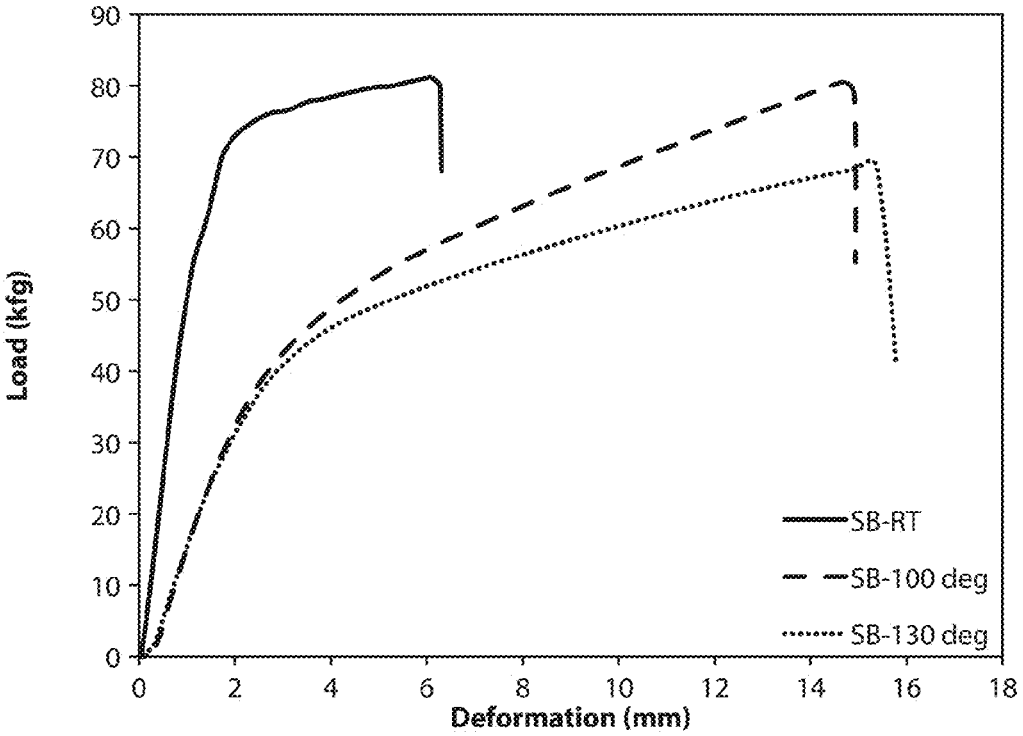
FIG. 14 is a graph showing the load-deformation response of an inventive abrasive disc at room temperature, 100° C., and 130° C.

Load deformation response testing (i.e., a measure of the maximum load before failure) of a composite backing material sample and a conventional backing vulcanized fiber material sample was conducted at room temperature (about 25° C.), 100° C., and 130° C. The load deformation response was measured according to the same method used to derive the tensile strength testing as described above, except that the Instron testing machine was equipped with an in situ furnace that heated the material samples at a rate of 10 degrees ° C. per minute up to the desired testing temperatures (e.g., 100° C. and 130° C.). The results for the comparative vulcanized fiber sample are shown in FIG. 13. The results for the inventive composite backing sample are shown in FIG. 14. Surprisingly and beneficially, the inventive sample had a percent decrease of maximum load at 100° C. compared to room temperature of only 1.4%. In great contrast, the conventional vulcanized fiber sample had a percent decrease of maximum load at 100° C. compared to room temperature of 40%. Further, surprisingly and beneficially, the inventive sample had a percent decrease of maximum load at 130° C. compared to room temperature of only 13%. In great contrast, the conventional vulcanized fiber sample had a percent decrease of maximum load at 130° C. compared to room temperature of 66%.

Figure 15:
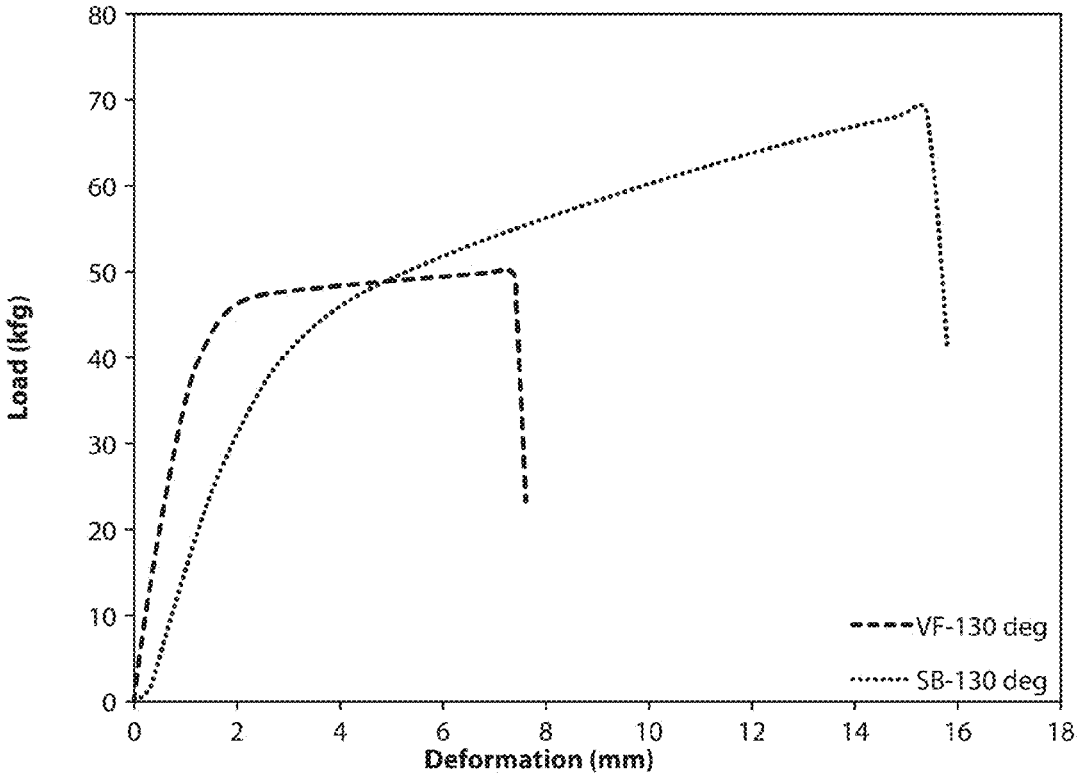
FIG. 15 is a graph comparing the load-deformation response of an inventive abrasive disc with a conventional vulcanized fiber disc at 130° C.

Moreover, as shown in FIG. 15, surprisingly and beneficially, the inventive sample had a significantly higher maximum load (approximately 70 Kgf) at 130° C. compared to the conventional vulcanized fiber sample (slightly under 50 Kgf).

Example 6—Flexural Modulus Testing Cross Direction

The inventive and comparative samples of Example 5 were subjected to Flexural modulus testing in the cross direction at room temperature (about 25° C.), 100° C., and 130° C. The results are shown in FIG. 16.

Figure 16:
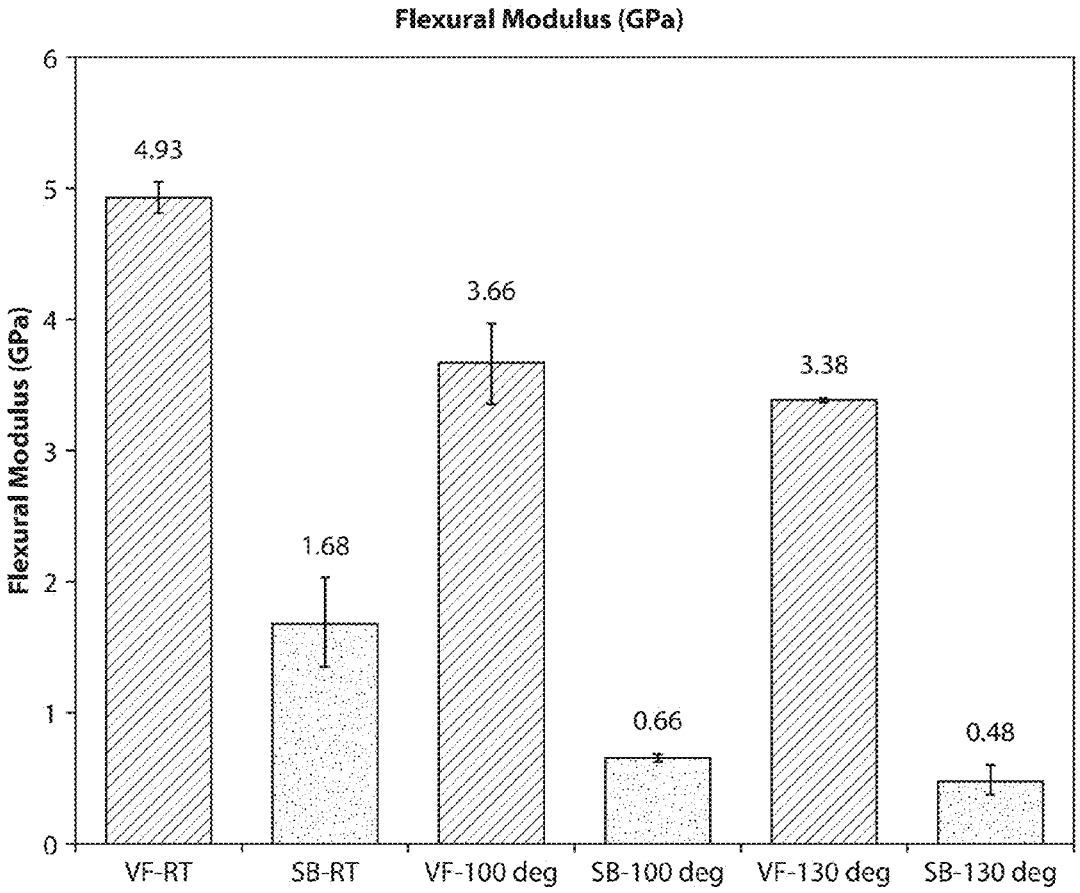
FIG. 16 is a graph comparing the flexural modulus of an inventive abrasive disc with a conventional vulcanized fiber disc at room temperature, 100° C., and 130° C.

As shown in FIG. 16, the inventive samples had a lower flexural modulus in the cross direction at all tested temperatures. This is a surprising result because it was unexpected that the inventive samples would have a lower flexural modulus while still having the beneficial load deformation response observed in Example 5.

Example 7—Dimensional Stability Testing—50° C. and 25% Relative Humidity

Inventive coated abrasive discs and comparative abrasive discs as prepared for field testing in Example 4 were subjected to dimensional stability testing to measure weight gain and dimensional distortion of the abrasive discs. The only difference between the inventive and comparative abrasive discs was the backing material.

Figure 17A:
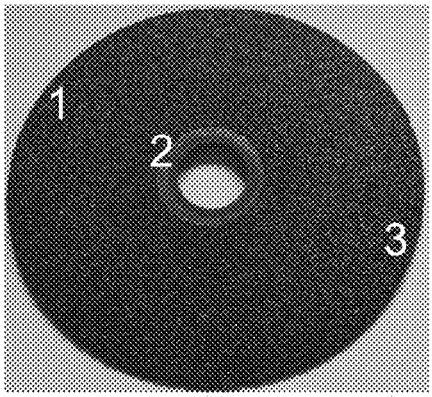
FIG. 17A is a photograph of a conventional vulcanized fiber abrasive disc prior to dimensional stability testing at a temperature of 50° C. and 25% relative humidity.
Figure 17B:
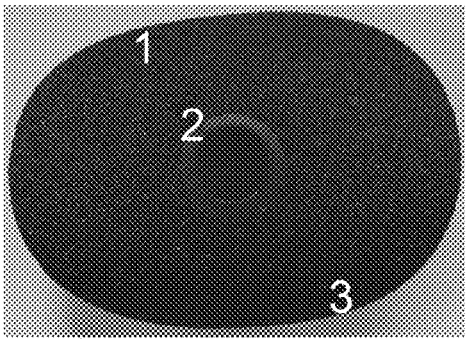
FIG. 17B is a photograph of a conventional vulcanized fiber abrasive disc after dimensional stability testing at a temperature of 50° C. and 25% relative humidity.
Figure 17C:
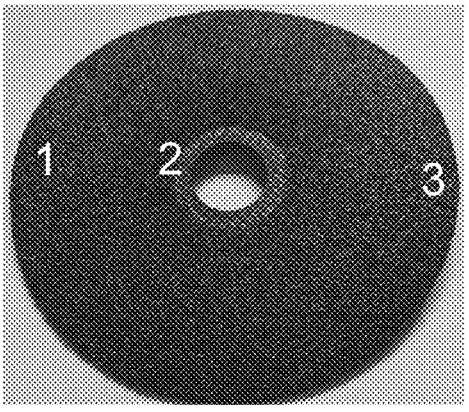
FIG. 17C is a photograph of an inventive abrasive disc embodiment prior to dimensional stability testing at a temperature of 50° C. and 25% relative humidity.
Figure 17D:
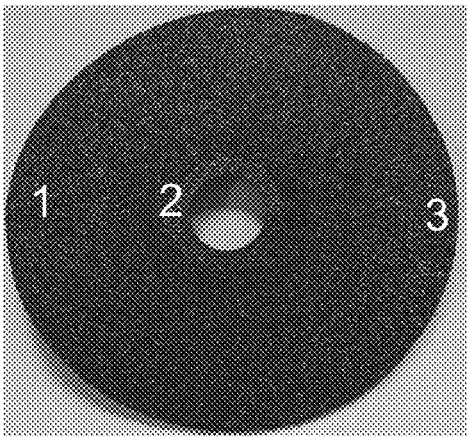
FIG. 17D is a photograph of an inventive abrasive disc embodiment after dimensional stability testing at a temperature of 50° C. and 25% relative humidity.
Figure 17E:
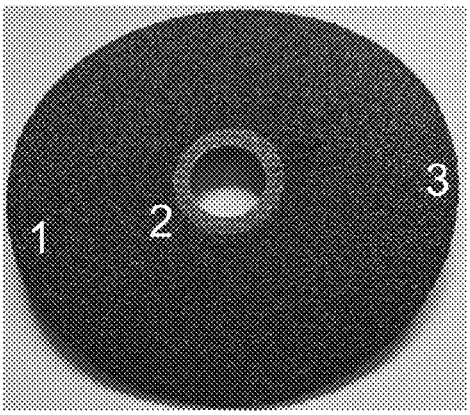
FIG. 17E is a photograph of another inventive abrasive disc embodiment prior to dimensional stability testing at a temperature of 50° C. and 25% relative humidity.
Figure 17F:
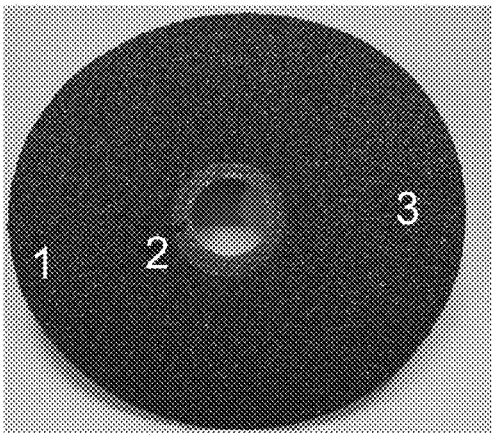
FIG. 17F is a photograph of another inventive abrasive disc embodiment after dimensional stability testing at a temperature of 50° C. and 25% relative humidity.

The inventive and comparative discs were placed in a climate chamber set to 50° C. and 25% relative humidity for 2.5 hours. FIG. 17A (comparative sample) and FIG. 17C and FIG. 17 E (inventive samples) show the samples prior to being placed in the climate chamber. FIG. 17B (comparative sample) and FIG. 17D and FIG. 17 F (inventive samples) show the samples after having been placed in the climate chamber for a fixed amount of time. As is shown in FIG. 17B, the conventional vulcanized fiber abrasive disc suffered significant dimensional distortion (severe curling and cupping of the disc). As is shown in FIGS. 17D and 17F, the inventive samples suffered very little dimensional distortion.

Figure 18:
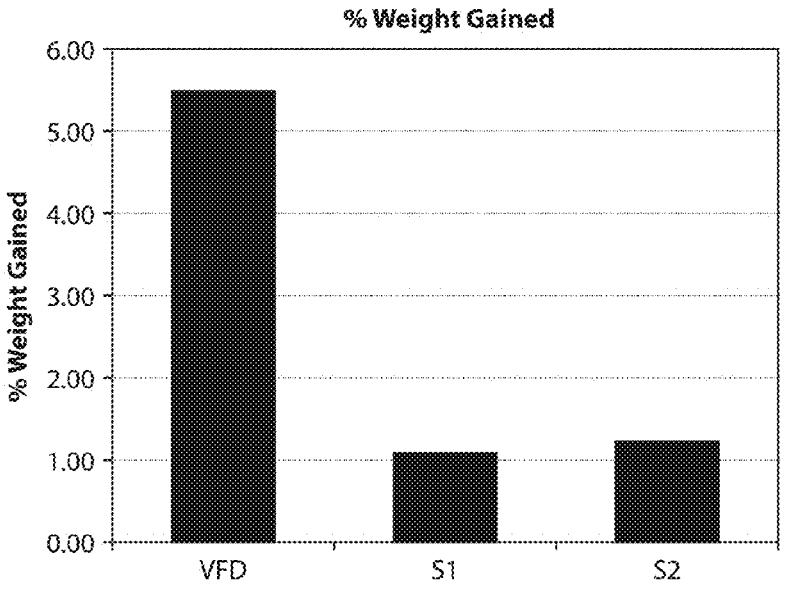
FIG. 18 is a bar graph comparing the percent (%) weight gained by the conventional abrasive disc and the inventive abrasive disc embodiments shown in FIGS. 17A-F due to dimensional stability testing at a temperature of 50° C. and 25% relative humidity.

The percent (%) weight gained is shown in FIG. 18. As can be seen the conventional sample gained greater than 5% weight. The inventive samples gained only just slightly over 1% weight.

Figure 19:
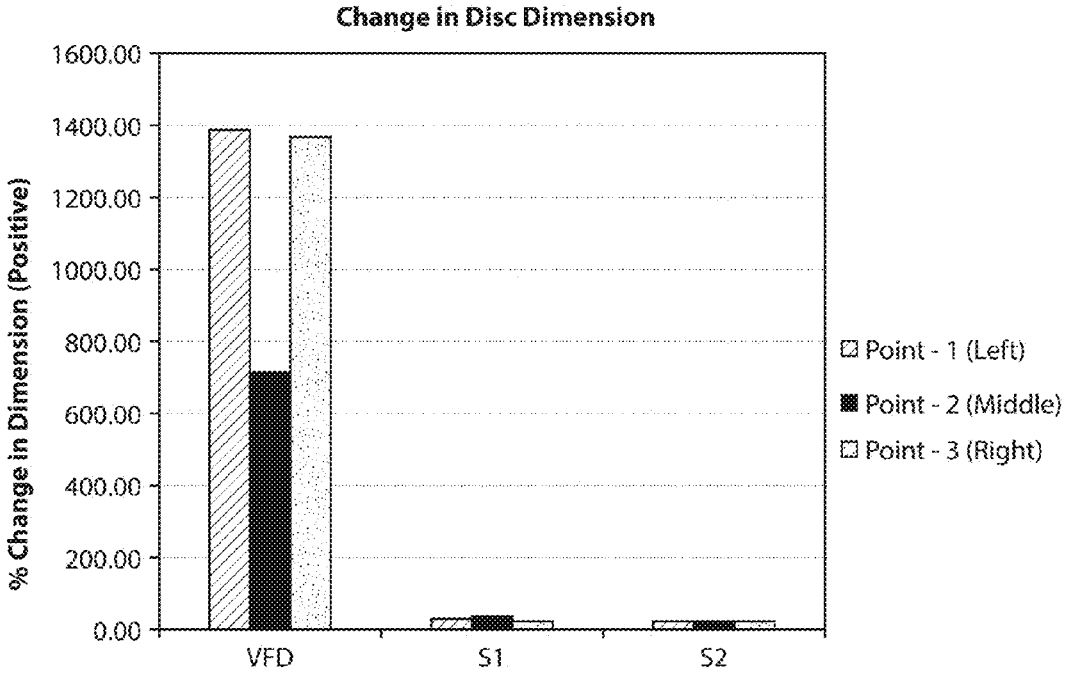
FIG. 19 is a graph showing the percent (%) change in dimensions of the conventional abrasive disc and the inventive abrasive disc embodiments shown in FIGS. 17A-F due to dimensional stability testing at a temperature of 50° C. and 25% relative humidity.

The change in disc dimensions is shown in FIG. 19. The change in disc dimensions was recorded by selecting three points on the surface of the abrasive disc, point 1 at the left edge of the disc, point 2 at the edge of the center hole of the disc, and point 3 at the right edge of the disc (See FIG. 17A-F) and recording their vertical distance while the disc was lying flat. The difference in vertical distance for the selected points was recorded before and after being placed in the climate chamber and used to calculate the change as a percent difference for each point. As can be seen, the conventional sample had changes in dimension that varied from 700% to slightly below 1400%, indicating severe warping and edge distortion. In contrast, the inventive samples have almost no measurable warping or distortion.

Example 8—Dimensional Stability Testing—35° C. and 85% Relative Humidity

Inventive coated abrasive discs and comparative abrasive discs as prepared for field testing in Example 4 were again subjected to dimensional stability testing to measure weight gain and dimensional distortion of the abrasive discs. The only difference between the inventive and comparative abrasive discs was the backing material.

Figure 20A:
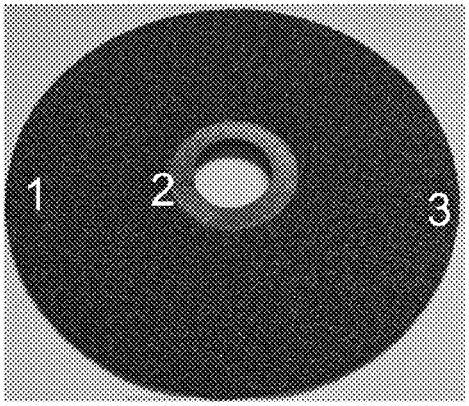
FIG. 20A is a photograph of a conventional vulcanized fiber abrasive disc prior to dimensional stability testing at a temperature of 35° C. and 85% relative humidity.
Figure 20B:
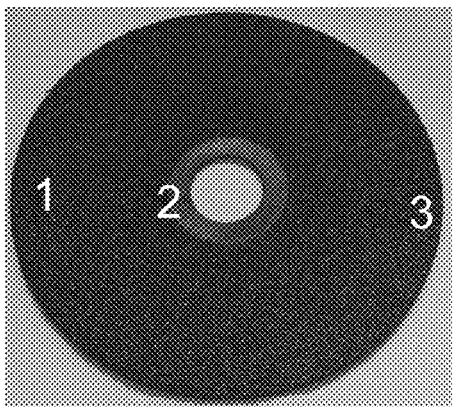
FIG. 20B is a photograph of a conventional vulcanized fiber abrasive disc after dimensional stability testing at a temperature of 35° C. and 85% relative humidity.
Figure 20C:
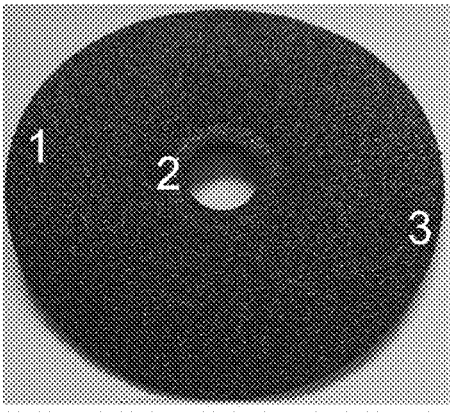
FIG. 20C is a photograph of an inventive abrasive disc embodiment prior to dimensional stability testing at a temperature of 35° C. and 85% relative humidity.
Figure 20D:
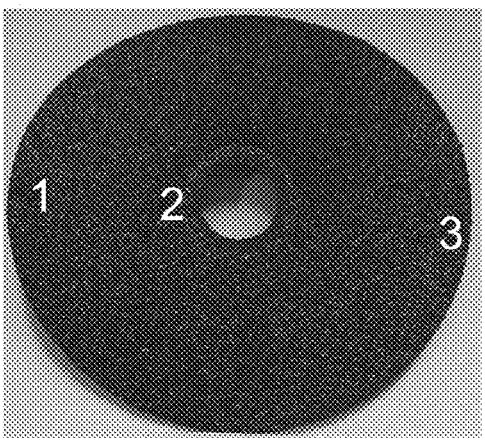
FIG. 20D is a photograph of an inventive abrasive disc embodiment after dimensional stability testing at a temperature of 35° C. and 85% relative humidity.
Figure 20E:
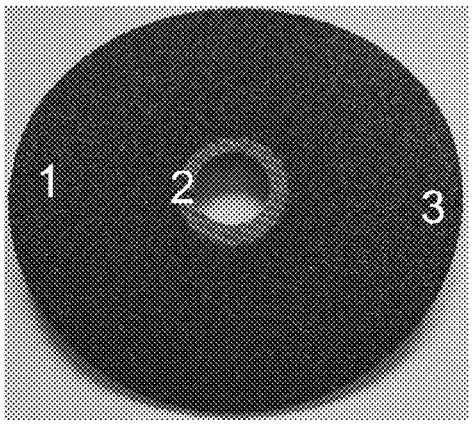
FIG. 20E is a photograph of another inventive abrasive disc embodiment prior to dimensional stability testing at a temperature of 35° C. and 85% relative humidity.
Figure 20F:
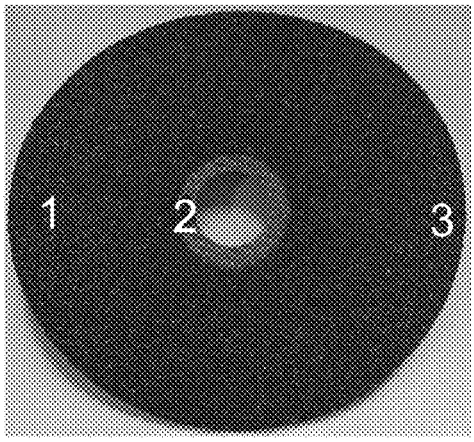
FIG. 20F is a photograph of another inventive abrasive disc embodiment after dimensional stability testing at a temperature of 35° C. and 85% relative humidity.

The inventive and comparative discs were placed in a climate chamber set to 35° C. and 85% relative humidity for 2.5 hours. FIG. 20A (comparative sample) and FIG. 20C and FIG. 20 E (inventive samples) show the samples prior to being placed in the climate chamber. FIG. 20B (comparative sample) and FIG. 20D and FIG. 20 F (inventive samples) show the samples after having been placed in the climate chamber for a fixed amount of time. As is shown in FIG. 20B, the conventional vulcanized fiber abrasive disc suffered some dimensional distortion (some warping and curling). As is shown in FIGS. 20D and 20F, the inventive samples suffered very little dimensional distortion.

Figure 21:
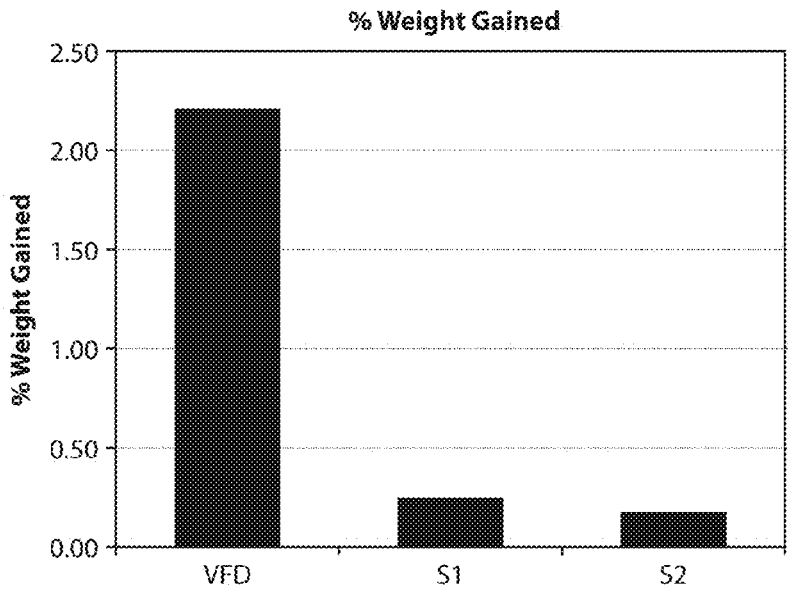
FIG. 21 is a bar graph comparing the percent (%) weight gained by the conventional abrasive disc and the inventive abrasive disc embodiments shown in FIGS. 20A-F due to dimensional stability testing at a temperature of 35° C. and 85% relative humidity.

The percent (%) weight gained is shown in FIG. 21. As can be seen the conventional sample gained slightly greater than 2% weight. The inventive samples gained only about 0.25% weight.

Figure 22:
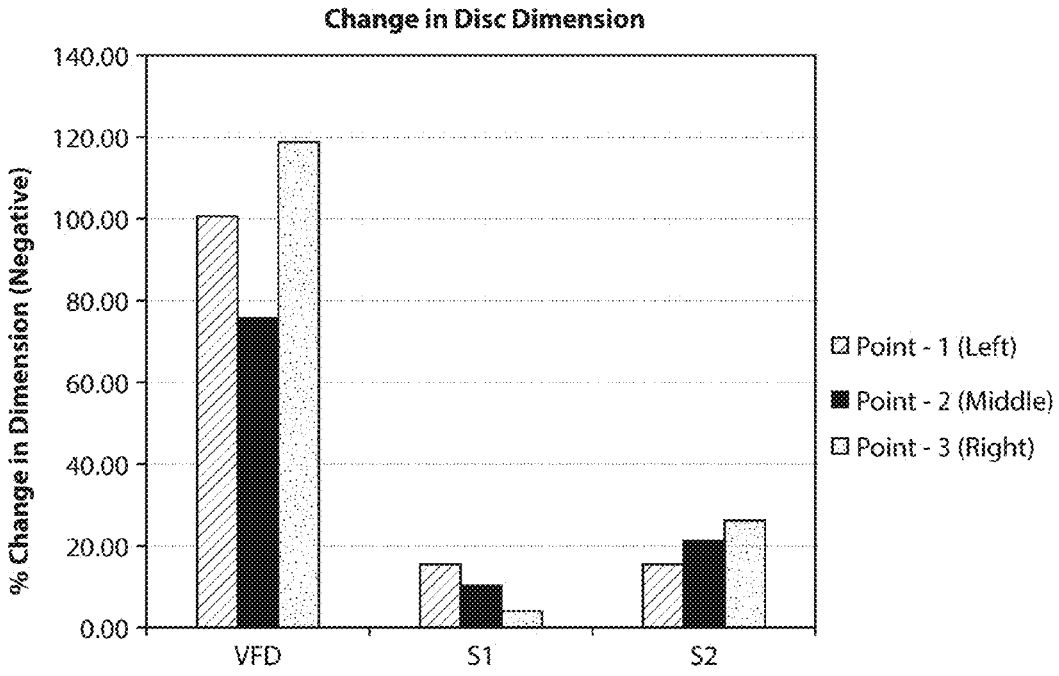
FIG. 22 is a graph showing the percent (%) change in dimensions of the conventional abrasive disc and the inventive abrasive disc embodiments shown in FIGS. 20A-F due to dimensional stability testing at a temperature of 35° C. and 85% relative humidity.

The change in disc dimensions is shown in FIG. 22. The change in disc dimensions was recorded by selecting three points along the center line of the abrasive disc, point 1 at the left edge of the disc, point 2 at the edge of the center hole of the disc, and point 3 at the right edge of the disc. As can be seen, the conventional sample had change in dimension that varied from just under 80% to slightly below 120%, indicating appreciable edge distortion. The inventive samples dimensional distortion ranging from a high of approximately 25% to less than 5%, indicating significant stability.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity can not be required, and that one or more further activities can be performed in addition to those described. Still further, the order in which activities are listed is not necessarily the order in which they are performed.

The disclosure is submitted with the understanding that it will not be used to limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Embodiment 1

A composite backing material comprising:

a nonwoven fabric impregnated with a first polymer composition, a frontfill layer disposed on a first side of the nonwoven fabric; and a backfill layer disposed on a second side of the nonwoven fabric.

Embodiment 2

The composite backing material of embodiment 1, wherein the first polymer composition comprises a phenolic composition.

Embodiment 3

The composite backing material of embodiment 2, wherein the first polymer composition comprises a phenolic resole composition.

Embodiment 4

The composite backing material of embodiment 3, wherein the phenolic resole composition comprises a combination of a first phenolic resole resin and a second phenolic resole resin.

Embodiment 5

The composite backing material of embodiment 4, wherein the first phenolic resole resin comprises a formaldehyde to phenol ratio (F/P ratio) in a range of 0.95 to 2.5.

Embodiment 6

The composite backing material of embodiment 4, wherein the first phenolic resole resin comprises a gel time at 121° C. in range of 5 minutes to 30 minutes.

Embodiment 7

The composite backing material of embodiment 4, wherein the first phenolic resole resin comprises a water tolerance in a range of 100% to 600%.

Embodiment 8

The composite backing material of embodiment 4, wherein the first phenolic resole resin comprises an F/P ratio in a range of 1.6 to 1.8, a gel time at 121° C. in a range of 8-12 minutes; and a water tolerance in a range of 150 to 300%.

Embodiment 9

The composite backing material of embodiment 4, wherein the second phenolic resole resin comprises a formaldehyde to phenol ratio (F/P ratio) in a range of 0.95 to 2.5.

Embodiment 10

The composite backing material of embodiment 4, wherein the second phenolic resole resin comprises a gel time at 121° C. in range of 5 minutes to 30 minutes.

Embodiment 11

The composite backing material of embodiment 4, wherein the second phenolic resole resin comprises a water tolerance in a range of 100% to 600%.

Embodiment 12

The composite backing material of embodiment 4, wherein the second phenolic resole resin comprises an F/P ratio in a range of 1.6 to 1.8, a gel time at 121° C. in a range of 8-12 minutes; and a water tolerance in a range of 150 to 300%.

Embodiment 13

The composite backing material of embodiment 4, wherein the first phenolic resole resin and the second phenolic resole resin are present in a ratio (first resin:second resin) ranging from 1:9 to 9:1, such as from 1:2 to 2:1; from 1:1.5 to 1.5:1; from 1:1.25 to 1.25:1; or about 1:1.

Embodiment 14

The composite backing material of embodiment 1, wherein the first polymeric composition cured comprises:

about 40 wt % to 60 wt % of a first phenolic resin; and about 40 wt % to 60 wt % of a second phenolic resin.

Embodiment 15

The composite backing material of embodiment 1, wherein the uncured first polymeric composition uncured comprises:

about 35 wt % to 55 wt % of a first phenolic resin;

about 35 wt % to 55 wt % of a second phenolic resin; and about 5 wt % to 10 wt % water.

Embodiment 16

The composite backing material of embodiment 1, wherein the first polymeric composition is uniformly dispersed throughout the nonwoven fabric.

Embodiment 17

The composite backing material of embodiment 1, wherein the amount of the first polymeric composition comprises 200 g/m$^2$ to 650 g/m$^2$; about 250 g/m$^2$ to 600 g/m$^2$; about 300 g/m$^2$ to 550 g/m$^2$; or about 400 g/m$^2$ to 500 g/m$^2$.

Embodiment 18

The composite backing material of embodiment 1, wherein the front fill layer comprises a second polymeric composition.

Embodiment 19

The composite backing material of embodiment 18, wherein the second polymeric composition comprises a first phenolic resole resin and a second phenolic resole resin.

Embodiment 20

The composite backing material of embodiment 19, wherein the ratio of first phenolic resol resin to second phenolic resole resin (first resin:second resin) is in a range of about 1:9 to 9:1, such as about 1:4 to 4:1, such as about 1:3 to 3:1, or about 1:2 to 2:1.

Embodiment 21

The composite backing material of embodiment 19, wherein the second polymeric composition further comprises a filler.

Embodiment 22

The composite backing material of embodiment 21, wherein the second polymeric composition cured comprises:
about 15 wt % to 30 wt % of a first phenolic resin;
about 40 wt % to 55 wt % of a second phenolic resin; and
about 25 wt % to 40 wt % filler.

Embodiment 23

The composite backing material of embodiment 21, wherein the second polymeric composition uncured comprises:
about 15 wt % to 28 wt % of a first phenolic resin;
about 32 wt % to 52 wt % of a second phenolic resin;
about 24 wt % to 40 wt % filler; and.
about 2 wt % to 10 wt % water.

Embodiment 24

The composite backing material of embodiment 21, wherein the amount of the second polymer composition comprises about 5 g/m$^2$ to 200 g/m$^2$; such as about 20 g/m$^2$ to 175 g/m$^2$; about 30 g/m$^2$ to 125 g/m$^2$; or 40 g/m$^2$ to 100 g/m$^2$.

Embodiment 25

The composite backing material of embodiment 1, wherein the back fill layer comprises a third polymeric composition.

Embodiment 26

The composite backing material of embodiment 25, wherein the third polymeric composition comprises an acrylic latex resin.

Embodiment 27

The composite backing material of embodiment 26, wherein the third polymeric composition further comprises a phenolic resole resin.

Embodiment 28

The composite backing material of embodiment 27, wherein the third polymeric composition further comprises a filler.

Embodiment 29

The composite backing material of embodiment 28, wherein the third polymeric composition cured comprises:
about 40 wt % to 62 wt % of an acrylic latex resin;
about 12 wt % to 20 wt % of a phenolic resin; and
about 25 wt % to 40 wt % filler.

Embodiment 30

The composite backing material of embodiment 28, wherein the third polymeric composition uncured comprises:
about 25 wt % to 55 wt % of an acrylic latex resin;
about 10 wt % to 20 wt % of a phenolic resin;
about 20 wt % to 30 wt % filler; and.
about 10 wt % to 20 wt % water.

Embodiment 31

The composite backing material of embodiment 28, wherein the third polymeric composition further comprises a thickener.

Embodiment 32

The composite backing material of embodiment 25, wherein the amount of the third polymer composition comprises about 5 g/m$^2$ to 200 g/m$^2$; about 30 g/m$^2$ to 150 g/m$^2$; 40 g/m$^2$ to 120 g/m$^2$; 60 g/m$^2$ to 100 g/m$^2$.

Embodiment 33

The composite backing material of embodiment 1, wherein the nonwoven fabric is a stitch bonded fabric.

Embodiment 34

The composite backing material of embodiment 33, wherein the stitch bonded fabric comprises a warp stitch bonded fabric, a weft stitch bonded fabric, or a combination thereof.

Embodiment 35

The composite backing material of embodiment 33, wherein the stitch bonded fabric comprises a plurality of webs.

Embodiment 36

The composite backing material of embodiment 35, wherein the plurality of webs comprises a cross-laid web disposed on a machine laid web.

Embodiment 37

The composite backing material of embodiment 35, wherein the plurality of webs comprises at least 2 webs and not greater than 10 webs.

Embodiment 38

The composite backing material of embodiment 33, wherein the stitch bonded fabric has a weight in a range of at least 50 grams per square meter (GSM) and not greater than 600 GSM; such as about 100 GSM to 500 GSM; about 200 GSM to 400 GSM; about 300 GSM to 390 GSM.

Embodiment 39

The composite backing material of embodiment 33, wherein the stitch bonded fabric comprises cotton, polyester, nylon, jute, aramide, viscose, or combinations thereof.

Embodiment 40

The composite backing material of embodiment 33, wherein the stitch bonded fabric comprises virgin fibers, recycled fibers, or a combination thereof.

Embodiment 41

The composite backing material of embodiment 33, wherein the stitch bonded fabric includes an anti-static agent Embodiment 42

The composite backing material of embodiment 33, wherein the stitch bonded fabric comprises a maliwatt fabric, a malivies fabric, a malimo fabric, a malipol fabric, a voltex fabric, a kunit fabric, a multiknit fabric, or combinations thereof.

Embodiment 43

The composite backing material of embodiment 33, wherein the stitch bonded fabric has a tensile strength in the machine direction in a range of not less than 1 Kg/25 mm and not greater than 100 Kg/25 mm.

Embodiment 44

The composite backing material of embodiment 33, wherein the stitch bonded fabric has a tensile strength in the cross direction in a range of not less than 1 Kg/25 mm and not greater than 100 Kg/25 mm.

Embodiment 45

The composite backing material of embodiment 33, wherein the stitch bonded fabric has a has a tensile strength in the machine direction and in the cross direction of not less than 15 Kg/25 mm.

Embodiment 46

The composite backing material of embodiment 1, wherein the ratio of the weight of the nonwoven fabric to the weight of the first polymeric composition is in a ratio ($Weight_{nw}$:$Weight_{dip}$) in a range from 1:9 to 9:1, such as from 1:2 to 2:1; from 1:1.5 to 1.5:1; from 1:1.25 to 1.25:1; or about 1:1.

Embodiment 47

The composite backing material of embodiment 18, wherein the ratio of the weight of the nonwoven fabric to the weight of the second polymeric composition is in a ratio ($Weight_{nw}$:$Weight_{front}$) is in a range from 1:9 to 9:1, such as from 1:2 to 2:1; from 1:1.5 to 1.5:1; from 1:1.25 to 1.25:1; or about 1:1. Ratio of mass front fill to mass nonwoven fabric.

Embodiment 48

The composite backing material of embodiment 25, wherein the ratio of the weight of the nonwoven fabric to the weight of the third polymeric composition is in a ratio ($Weight_{nw}$:$Weight_{back}$) is in a range from 1:9 to 9:1, such as from 1:2 to 2:1; from 1:1.5 to 1.5:1; from 1:1.25 to 1.25:1; or about 1:1. Ratio of mass front fill to mass nonwoven fabric.

Embodiment 49

The composite backing material of embodiment 1 having a total thickness in a range from 0.5 mm to 5 mm.

Embodiment 50

The composite backing material of embodiment 1, wherein the composite backing material has a tensile strength in the machine direction in a range of 60 Kg/25 mm to 160 Kg/25 mm.

Embodiment 51

The composite backing material of embodiment 1, wherein the backing material has a tensile strength in the cross direction in a range of 50 Kg/25 mm to 110 Kg/25 mm.

Embodiment 52

The composite backing material of embodiment 1, wherein the composite backing material has a flexural modulus in the machine direction in a range of 1 GPa to 7 GPa.

Embodiment 53

The composite backing material of embodiment 1, wherein the backing material has a flexural modulus in the cross direction in a range of 0.5 GPa to 5 GPa.

Embodiment 54

A coated abrasive article comprising:
a composite backing material; and
an abrasive layer disposed on the composite backing material.

Embodiment 55

The abrasive article of embodiment 53, wherein the composite backing material comprises:
a nonwoven fabric that is impregnated with a first polymer composition,
a frontfill layer that is disposed on a first side of the nonwoven fabric; and
a backfill layer that is disposed on a second side of the nonwoven fabric.

Embodiment 56

The abrasive article of embodiment 55, wherein the nonwoven fabric is a stitch bonded fabric.

Embodiment 57

The abrasive article of embodiment 55, wherein the abrasive layer comprises a binder composition and abrasive particles disposed on or in the binder composition.

Embodiment 58

The abrasive article embodiment 57, wherein the binder composition comprises a polymeric binder composition.

Embodiment 59

The abrasive article of embodiment 57, wherein the abrasive layer comprises abrasive particles disposed on the binder composition.

Embodiment 60

The abrasive article of embodiment 57, wherein the abrasive layer comprises an abrasive slurry of abrasive particles dispersed in the binder composition.

Embodiment 61

The abrasive article of embodiment 54, further comprising a size coat disposed over the abrasive layer.

Embodiment 62

The abrasive article of embodiment 57, further comprising a super-size coat disposed over the size coat.

Embodiment 63

The abrasive article of embodiment 55, wherein the abrasive article has a teak wood material cut rating of at least 1000 cm3 in 30 minutes.

Embodiment 64

The abrasive article of embodiment 55, wherein the abrasive article has a rosewood wood material cut rating of at least 500 cm3 in 30 minutes.

Embodiment 65

The abrasive article of embodiment 55, wherein the abrasive article has a teak wood field test lifetime of at least 35 minutes.

Embodiment 66

The abrasive article of embodiment 55, wherein the abrasive article has an improved abrasive performance (Volume Ground) of at least 20% compared to a conventional abrasive article, wherein the only difference between the abrasive article and comparative abrasive article is that the backing material of the comparative abrasive article is vulcanized fiber.

Embodiment 67

The abrasive article of embodiment 57, wherein the abrasive article has the same teakwood cut rating as conventional abrasive article but has not greater than 90% of the amount of abrasive particles as the conventional abrasive article, such as not greater than 85%, not greater than 80%, not greater than 75%, not greater than 70%, not greater than 65%, not greater than 60%, not greater than 55%, not greater than 50%, not greater than 45%, not greater than 40%, not greater than 35%, not greater than 30%, not greater than 25%, not greater than 20%, not greater than 15%, not greater than 10%, or not greater than 5% of the amount of abrasive particles as the conventional abrasive article and the only other difference between the abrasive article and the comparative abrasive article is that the backing material of the comparative abrasive article is vulcanized fiber.

Embodiment 68

The abrasive article of embodiment 55, wherein the abrasive article has a lower specific grinding energy (SGE) compared to a conventional abrasive article, wherein the only difference between the abrasive article and comparative abrasive article is that the backing material of the comparative abrasive article is vulcanized fiber.

Embodiment 69

The abrasive article of embodiment 55, wherein the abrasive article has not greater than a 50% decrease of maximum load at 130° C. compared to room temperature.

Embodiment 70

The abrasive article of embodiment 55, wherein when the abrasive article is placed in a climate chamber at a temperature of 50° C. and 25% relative humidity (RH) for 2.5 hours has a % weight gain of less than 5.5%.

Embodiment 71

The abrasive article of embodiment 55, wherein when the abrasive article is placed in a climate chamber at a temperature of 35° C. and 85% relative humidity (RH) for 2.5 hours has a % weight gain of less than 2.25%.

Embodiment 72

The abrasive article of embodiment 55, wherein when the abrasive article is placed in a climate chamber at a temperature of 50° C. and 25% relative humidity (RH) for 2.5 hours has a three-point dimensional stability where all three points have a % change in dimension of less than 700%.

Embodiment 73

The abrasive article of embodiment 55, wherein when the abrasive article is placed in a climate chamber at a temperature of 35° C. and 85% relative humidity (RH) for 2.5 hours has a three-point dimensional stability where all three points have a % change in dimension of less than 75%.

Embodiment 74

The abrasive article of embodiment 55, wherein the abrasive article is in the form of a belt, a sheet, a disc, a plurality of flaps, or a combination thereof.

Embodiment 75

The abrasive article of embodiment 74, wherein the disc shape can be round, a regular polygon, an irregular polygon, a rosette, or combinations thereof.

Embodiment 76

The abrasive article of embodiment 74, wherein the disc or sheet further comprises a hook and loop attachment system or a pressure sensitive adhesive attachment system, or a combination thereof.

Embodiment 77

The abrasive article of embodiment 74, wherein the belt is a file belt, a portable belt, a Narrow belt (less than 300 mm wide), a Wide belt (at least 300 mm wide), or combinations thereof.

Embodiment 78

The coated abrasive of embodiment 62, wherein the supersize coat comprises a stearate.

Embodiment 79

A method of making a composite backing material comprising:

impregnating a nonwoven fabric with a first polymer composition to form a polymer impregnated fabric;

curing, at least partially, the polymer impregnated fabric;

applying a second polymer composition to a first side of the polymer impregnated fabric to form a front fill layer;

curing, at least partially, the front fill layer;

applying a third polymer composition to a second side of the polymer impregnated fabric to form a backfill layer;

curing, at least partially, the back fill layer to form a composite backing material.

Embodiment 80

The method of embodiment 75, wherein the nonwoven fabric is a stitch bonded fabric.

Embodiment 81

A method of making an abrasive article, comprising:

disposing an abrasive layer on a composite backing material to form an abrasive article, wherein the composite backing material comprises a nonwoven fabric that is impregnated with a first polymer composition, a frontfill layer that is disposed on a first side of the nonwoven fabric; and a backfill layer that is disposed on a second side of the nonwoven fabric, and wherein the abrasive layer is disposed on the front fill layer.

Embodiment 82

The method of embodiment 77, wherein the nonwoven fabric is a stitch bonded fabric.

Thus, to the maximum extent allowed by law, the scope of the present invention is to be determined by the broadest permissible interpretation of the following claims and their equivalents, and shall not be restricted or limited by the foregoing detailed description.

What is claimed is:

1. A composite backing material comprising:

a nonwoven stitch bonded fabric impregnated with a first polymer composition, a frontfill layer disposed on a first side of the nonwoven fabric; and a backfill layer disposed on a second side of the nonwoven fabric, wherein the first polymer composition comprises a combination of a first phenolic resole resin and a second phenolic resole resin, and wherein the first polymer composition cured comprises:

about 40 wt % to 60 wt % of the first phenolic resole resin; and about 40 wt % to 60 wt % of the second phenolic resole resin.

2. The composite backing material of claim 1, wherein the front fill layer comprises a second polymeric composition comprising a first phenolic resole resin and a second phenolic resole resin.

3. The composite backing material of claim 2, wherein the second polymeric composition further comprises a filler.

4. The composite backing material of claim 3, wherein the second polymeric composition cured comprises:

about 15 wt % to 30 wt % of the first phenolic resole resin;

about 40 wt % to 55 wt % of the second phenolic resole resin; and about 25 wt % to 40 wt % filler.

5. The composite backing material of claim 1, wherein the back fill layer comprises a third polymeric composition comprising an acrylic latex resin.

6. The composite backing material of claim 5, wherein the third polymeric composition further comprises a phenolic resole resin.

7. The composite backing material of claim 6, wherein the third polymeric composition further comprises a filler.

8. The composite backing material of claim 7, wherein the third polymeric composition cured comprises:

about 40 wt % to 62 wt % of an acrylic latex resin;

about 12 wt % to 20 wt % of a phenolic resin; and about 25 wt % to 40 wt % filler.

9. The composite backing material of claim 1, wherein the stitch bonded fabric has a tensile strength in the machine direction and in the cross direction of not less than 15 Kg/25 mm.

10. The composite backing material of claim 1, wherein the composite backing material has a tensile strength in the machine direction in a range of 60 Kg/25 mm to 160 Kg/25 mm.

11. The composite backing material of claim 1, wherein the backing material has a tensile strength in the cross direction in a range of 50 Kg/25 mm to 110 Kg/25 mm.

12. The composite backing material of claim 1, wherein the composite backing material has a flexural modulus in the machine direction in a range of 1 GPa to 7 GPa.

13. The composite backing material of claim 1, wherein the backing material has a flexural modulus in the cross direction in a range of 0.5 GPa to 5 GPa.

14. A coated abrasive article comprising:

a composite backing material according to claim 1; and an abrasive layer disposed on the composite backing material.

15. The abrasive article of claim 14, wherein the abrasive article has not greater than a 50% decrease of maximum load at 130° C. compared to room temperature.

16. The abrasive article of claim 14, wherein when the abrasive article is placed in a climate chamber at a temperature of 50° C. and 25% relative humidity (RH) for 2.5 hours has a % weight gain of less than 5.5%.

17. A composite backing material comprising:

a nonwoven stitch bonded fabric impregnated with a first polymer composition, a frontfill layer disposed on a first side of the nonwoven fabric; and a backfill layer disposed on a second side of the nonwoven fabric, wherein the first polymer composition comprises a combination of a first phenolic resole resin and a second phenolic resole resin, and wherein the back fill layer comprises:

about 40 wt % to 62 wt % of an acrylic latex resin;

about 12 wt % to 20 wt % of a phenolic resin; and about 25 wt % to 40 wt % filler.

18. A composite backing material comprising:

a nonwoven stitch bonded fabric impregnated with a first polymer composition, a frontfill layer disposed on a first side of the nonwoven fabric; and a backfill layer disposed on a second side of the nonwoven fabric, wherein the first polymer composition comprises a combination of a first phenolic resole resin and a second phenolic resole resin, wherein the front fill layer comprises a second polymeric composition comprising about 15 wt % to 30 wt % of a first phenolic resole resin;

about 40 wt % to 55 wt % of a second phenolic resole resin; and about 25 wt % to 40 wt % of a filler.

* * * * *